US006559874B2

(12) United States Patent
Tanaka et al.

(10) Patent No.: US 6,559,874 B2
(45) Date of Patent: May 6, 2003

(54) PRINTING METHOD AND PRINTING APPARATUS, LASER OUTPUT CONTROL DEVICE AND CONTROL DEVICE AND CONTROL METHOD FOR PRINTING APPARATUS, AND PRINTING REGISTER CONTROL DEVICE FOR PRINTING APPARATUS

(75) Inventors: Tamihiko Tanaka, Yokohama (JP); Makoto Hayashi, Zama (JP); Mitsuhiko Iida, Setagaya-ku (JP); Junji Tsunekawa, Zama (JP); Yoshihiko Butsusaka, Zama (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/058,293

(22) Filed: Jan. 30, 2002

(65) Prior Publication Data

US 2002/0101493 A1 Aug. 1, 2002

(30) Foreign Application Priority Data

| | | |
|---|---|---|
| Jan. 30, 2001 | (JP) | 2001-021512 |
| Feb. 14, 2001 | (JP) | 2001-037289 |
| Mar. 19, 2001 | (JP) | 2001-078262 |
| May 1, 2001 | (JP) | 2001-134305 |

(51) Int. Cl.[7] ..... B41J 2/435

(52) U.S. Cl. ..... 347/115; 347/132; 347/900; 358/1.9

(58) Field of Search ..... 347/115, 118, 347/119, 132, 232, 900; 358/1.9, 1.16, 1.17, 524

(56) References Cited

U.S. PATENT DOCUMENTS

| | | | | |
|---|---|---|---|---|
| 5,003,494 A | * | 3/1991 | Ng | 358/1.9 |
| 5,359,432 A | * | 10/1994 | Peltzer et al. | 358/452 |
| 5,990,922 A | * | 11/1999 | Lee | 358/1.16 |

* cited by examiner

*Primary Examiner*—Joan Pendegrass
(74) *Attorney, Agent, or Firm*—Pillsbury Winthrop LLP

(57) ABSTRACT

A driving means 6 is placed below a photoconductor drum 2. The driving means 6 includes first to fourth developing rollers 13A–13D and toner storage chambers 11A–11D. The developing means 6 can be shifted by a developing-device moving motor 9 to bring one of the developing rollers 13A–13D which corresponds to one of liquid toners 12A–12D to be developed in close to the photoconductor drum 2, followed by developing a latent image formed by an exposure. At this time, the distance between one of the developing rollers 13A–13D and the photoconductor drum 2 can be appropriately adjusted. In addition, before the development, meniscus of the liquid toner is quickly formed between the developing rollers 13A–13D and the photoconductor drum 2 by rotating the development rollers 13A–13 at the rotation speed higher than the rotation speed thereof at the development.

3 Claims, 18 Drawing Sheets

FIG.11

DA

ORIGINAL IMAGE (DRAWING DATA)

| | | | | | | | | | | | | | | | |
|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 |
| 17 | 18 | 19 | 20 | 21 | 22 | 23 | 24 | 25 | 26 | 27 | 28 | 29 | 30 | 31 | 32 |
| 33 | 34 | 35 | 36 | 37 | 38 | 39 | 40 | 41 | 42 | 43 | 44 | 45 | 46 | 47 | 48 |
| 49 | 50 | 51 | 52 | 53 | 54 | 55 | 56 | 57 | 58 | 59 | 60 | 61 | 62 | 63 | 64 |
| 65 | 66 | 67 | 68 | 69 | 70 | 71 | 72 | 73 | 74 | 75 | 76 | 77 | 78 | 79 | 80 |
| 81 | 82 | 83 | 84 | 85 | 86 | 87 | 88 | 89 | 90 | 91 | 92 | 93 | 94 | 95 | 96 |
| 97 | 98 | 99 | 100 | 101 | 102 | 103 | 104 | 105 | 106 | 107 | 108 | 109 | 110 | 111 | 112 |
| 113 | 114 | 115 | 116 | 117 | 118 | 119 | 120 | 121 | 122 | 123 | 124 | 125 | 126 | 127 | 128 |
| 129 | 130 | 131 | 132 | 133 | 134 | 135 | 136 | 137 | 138 | 139 | 140 | 141 | 142 | 143 | 144 |
| 145 | 146 | 147 | 148 | 149 | 150 | 151 | 152 | 153 | 154 | 155 | 156 | 157 | 158 | 159 | 160 |

FIG.14

75 75A 75B

| COLOR 4 | COLOR 3 | COLOR 2 | COLOR 1 | K | C | M | Y | TABLE ADDRESS | OUTPUT DATA |
|---|---|---|---|---|---|---|---|---|---|
| BIT 7 | BIT 6 | BIT 5 | BIT 4 | BIT 3 | BIT 2 | BIT 1 | BIT 0 | | |
| 0 | 0 | 0 | 0 | 0 | 0 | 0 | 0 | 0 | 0 |
| 0 | 0 | 0 | 0 | 0 | 0 | 0 | 1 | 1 | 100 |
| 0 | 0 | 0 | 0 | 0 | 0 | 1 | 0 | 2 | 120 |
| 0 | 0 | 0 | 0 | 0 | 0 | 1 | 1 | 3 | 220 |
| 0 | 0 | 0 | 0 | 0 | 1 | 0 | 0 | 4 | 120 |
| 0 | 0 | 0 | 0 | 0 | 1 | 0 | 1 | 5 | 230 |
| 0 | 0 | 0 | 0 | 0 | 1 | 1 | 0 | 6 | 230 |
| 0 | 0 | 0 | 0 | 0 | 1 | 1 | 1 | 7 | 235 |
| 0 | 0 | 0 | 0 | 1 | 0 | 0 | 0 | 8 | 100 |
| 0 | 0 | 0 | 0 | 1 | 0 | 0 | 1 | 9 | 220 |
| 0 | 0 | 0 | 0 | 1 | 0 | 1 | 0 | 10 | 230 |
| 0 | 0 | 0 | 0 | 1 | 0 | 1 | 1 | 11 | 235 |
| 0 | 0 | 0 | 0 | 1 | 1 | 0 | 0 | 12 | 220 |
| 0 | 0 | 0 | 0 | 1 | 1 | 0 | 1 | 13 | 235 |
| 0 | 0 | 0 | 0 | 1 | 1 | 1 | 0 | 14 | 235 |
| 0 | 0 | 0 | 0 | 1 | 1 | 1 | 1 | 15 | 235 |
| 0 | 0 | 0 | 1 | 0 | 0 | 0 | 0 | 16 | 120 |
| 0 | 0 | 0 | 1 | 0 | 0 | 0 | 1 | 17 | 200 |
| 0 | 0 | 0 | 1 | 0 | 0 | 1 | 0 | 18 | 220 |
| | | | | | | | | ⋮ | |
| | | | | | | | | 255 | |

DD

PRINTING METHOD AND PRINTING APPARATUS, LASER OUTPUT CONTROL DEVICE AND CONTROL DEVICE AND CONTROL METHOD FOR PRINTING APPARATUS, AND PRINTING REGISTER CONTROL DEVICE FOR PRINTING APPARATUS

BACKGROUND OF THE INVENTION

1. Field of the Invention

The present invention relates to a printing method and a printing apparatus for developing a latent image on the surface of a photo-conductor drum using liquid toner, to a control device and a control method for controlling a laser output of the printing device, and to a resister control device of the printing device.

2. Description of the Related Art

Heretofore, wet-type electro photographic printing apparatuses have been known in the art, which is provided for forming an image on the surface of a photoconductor drum being rotated at a constant speed by successively overlaying colors such as yellow (Y), magenta (M), cyan (C), and black (K) and then transferring an image formed by overlaying one image on another using a plurality of different color liquid toners onto a sheet of printing paper placed between a transfer roller and a backup roller through the transfer roller. The printing apparatus comprises: charging means for charging the surface of a photoconductor drum having a photosensitivity; exposing means for performing an exposure scan on the photoconductor drum on the basis of drawing data to form a latent image on the photoconductor drum; and developing means for developing the latent image on the photoconductor drum. The developing means includes a plurality of developing rollers that sequentially supply liquid toners of multiple colors on the photoconductor drum.

Furthermore, the exposing means includes a laser-emitting source, a polygon scanner, or the like. A laser beam emitted from the laser-emitting source is incident on the polygon scanner being rotated at a predetermined speed and is then reflected from the polygon scanner. Subsequently, the reflected laser beam passes through an fθ lens and scans the surface of the photoconductor drum to make a latent image.

Conventionally, such a kind of printing apparatus performs the following process.

First, the charging device charges the surface of the photoconductor drum on the basis of an image data. Then, the exposing device forms a latent image on the surface of the photoconductor drum on the basis of a drawing data. Subsequently, the latent image is developed by liquid toner to make an image.

The development with liquid toner is performed by bringing a developing roller partially dipping in the liquid toner close to the photoconductor drum and then revolving it around its axis. On this occasion, meniscus is formed in a comparatively narrow space between the developing roller and the photoconductor drum because the surface of the liquid turner in the space wets them and is provided as a bridge between them. Then, a potential difference is applied on between the exposed surface portion and the remaining surface portion on the photoconductor and the developing roller to permit the electrophoresis movement of liquid toner in the meniscus. As a result, the liquid toner is supplied from the developing roller to the photoconductor roller.

Subsequently, the image formed on the surface of the photoconductor drum is transferred to the surface of a transfer roller. Then, a sheet of printing paper is fed between the transfer roller having the transferred image and the backup roller. Consequently, the image on the transfer roller is transferred on the surface of the printing paper while the paper passes through between the rollers.

In the case of forming an image on the photoconductor drum by supplying liquid toner from the developing roller to the photoconductor drum, an excess amount of the liquid toner may be supplied as a result of capillary phenomenon when the distance between the developing roller and the photoconductor roller becomes closer than the predetermined distance, resulting in an indistinct image. On the other hand, if these rollers are located too far from each other, poor meniscus of the liquid toner can be formed between the rollers. As a result, the liquid toner cannot be transferred from the developing roller to the photoconductor drum, so that the image formation cannot be performed. On the other hand, there are various kinds of customers' needs for printed materials to be obtained by the printing apparatus constructed as described above, such as for different sizes (e.g., A1-, A2-, and B1-sizes) and thicknesses of sheets of printing paper. For printing a multi-color image, in most cases, all of two or more colors to be required are stacked on the same place one after another and a thickness of one area on the recording medium may become different from that of another area depending on the number of colors being stacked on each area. Therefore, printing conditions including the rotation speed of photoconductor drum, the rotation speed of developing roller, the properties of liquid toner, and so on should be adjusted to obtain an appropriate distance between the developing roller and the photoconductor roller for allowing the most clear image every time the customer performs a printing using liquid toner and recording medium which are different from those used in the latest printing.

Conventionally, however, the developing roller and the photoconductor have been kept at a constant distance from each other on the basis of the operator's practical experience and guesswork, so that the resulting image may be subtly deferent from one previously printed every time the image is printed under the different conditions, causing a problem of an undesired effect on the image quality.

Therefore one of the objects of the present invention is to provide a printing apparatus that keeps an excellent image quality by avoiding an influence upon an image to be exerted by the image formation on the surface of photoconductor drum using liquid toner.

In the case of forming an image on the photoconductor drum in an image-on-image fashion, on the other hand, an image development can be performed by causing the migration of charged toner particles when the potential of an area exposed by a beam of laser (i.e., an area on which electrostatic latent image is formed) becomes less than the potential of the developing roller with respect to the potential of charged photoconductor drum. For example, a laser-exposure potential to be defined by the sensitivity for a laser wavelength can be obtained on the surface of photoconductor drum for an image formation of a first color. At the time of forming an image of second color, a laser-exposure potential to be defined by the sensitivity for a laser wavelength can be obtained on another part of the surface of photoconductor drum, which is not exposed in the step of first color, for an image formation of a second color. In this case, however, if the second color is applied on the same area as that of the first color, there is a possibility that a desired laser exposure potential cannot be attained because of the presence of first-color toner on that area. The existing toner absorbs or reflects laser energies, so that the desired laser exposure potential cannot be obtained when the laser's output power is not adjusted. As a result, it becomes difficult to obtain a clear image, causing a problem of an undesired effect on the image quality.

Furthermore, for adjusting the output of laser, a data for each color as a part of output data of laser should be kept to define an output data for printing such a color. Here, if the resolution of the laser output is 256 levels of gradation, for example, 8 bits of data can be required for one dot (one pixel). Therefore, for example, for successively stacking eight colors (e.g., yellow and so on) on an area corresponding to one pixel, 64 bits of data (i.e., 8 bits×8 colors=64 bits) per pixel is required. Thus, the more the size of an image to be printed is increased or the more the resolution increases, the more space for storing laser output data in the large storing device is required.

Therefore, another object of the present invention is to provide a laser-output control device and a method for controlling a laser output, where a clear image can be obtained by controlling a laser power such that the laser power is appropriately adjusted under the conditions of stacking colors on the same image-forming area, or under the conditions of without stacking colors.

A still another embodiment of the present invention is to provide a laser-output control device to be equipped in a wet type electro photographic printing apparatus for allowing the reduction in the capacity of the recording device that stores laser output data, and is also to provide a method for controlling the laser output.

In the above printing apparatus, furthermore, the photoconductor drum and a polygon scanner of exposure means are capable of rotating at a constant speed respectively in isolation from each other. Therefore, there is a possibility of causing out-of-register colors, i.e., a second or later color cannot be positioned properly on an initial position of image formation, which is a position for starting a scanning movement of the polygon scanner on the surface of the photoconductor drum, resulting in an unclear image. In this case, therefore, there is a problem in which a high-quality printed material cannot be obtained.

Another object of the present invention is to provide a resister control device of a printing apparatus for obtaining a high-quality printed material by maintaining register of each color to a high degree when a multi-color image is formed on the surface of a photoconductor drum using liquid toner In the conventional printing method, liquid toner is supplied to the surface of a photoconductor drum by permitting a rotational movement of a developing toner at a const speed. Thus, it is difficult to promptly make meniscus of the liquid toner between the surface of the developing roller and the surface of the photoconductor roller at the time of liquid-toner supply by making them close to each other. In particular, in the case of a multi-color printing using liquid toners of four different colors, there is a possibility of slightly sifting the time of forming meniscus at the time of starting a development for each color from its predetermined time. Such a time lag causes an unstable image development, so that there is a possibility that the decrease in printing quality may be caused as the resulting image may be unclear.

Therefore, another object of the present invention is to provide a printing method and a printing apparatus that improve the quality of printing.

SUMMARY OF THE INVENTION

An first aspect of the present invention is a printing apparatus, comprising a photoconductive drum having a surface on which an image is formed; a charging means or charging the surface of the photoconductive drum; an exposure means for preparing an electrostatic latent image by exposing the surface of the photoconductor drum after the charging with the charging means; a developing means for developing the electrostatic latent image by supplying liquid toner on the surface of the photoconductor by electrophoresis after the exposure with the exposure means; a transfer roller for receiving the image after the development with the developing means; a backup roller for transferring the image from the transfer means to a printing paper; and a control means for controlling the charging means, the exposure means, the developing means, the transfer roller, and the backup roller, where the developing means includes a main body of an developing device for storing the liquid toner and developing rollers mounted on the main body and supplies the liquid toner to the photoconductor drum to allow the development, and a distance between the surface of the developing roller and the surface of the photoconductor drum is adjustable.

According to this invention, the distance between the surface of each of the first, second, third, and fourth developing rollers and the surface of the photoconductor drum can be adjustable, so that the distance can be appropriately defined for various kinds of printing movements, depending on the rotation speeds of the photoconductor roller and developing rollers, the properties of liquid toner. Consequently, the liquid toner can be supplied with an appropriate distance that allows the formation of a clear image, so that an image with an excellent quality can be maintained while avoiding an influence upon an image.

In the printing apparatus of the present invention, preferably, a main body of the developing device has a plurality of toner storage chambers for storing liquid toners corresponding to a plurality of printing colors, and each of the developing rollers is arranged in each of the toner storage chambers.

According to this invention, liquid toner of each color to be printed can be stored in one of the toner storage chamber and the developing rollers are provided for the respective chambers, so that multi-color printing can be performed without causing undesired mixing of colors, adapting to better meet various customers' needs.

In the printing apparatus of the present invention, preferably, the photoconductor drum has a drawing area on which a drawing is performed and a non-drawing area on which a drawing is not performed; and the transfer roller has a drawing area on which a drawing is performed and a non-drawing area on which a drawing is not performed, where a diameter of the photoconductor drum is equal to a diameter of the transfer roller, and movements of the main body of the developing device and the developing roller for a predetermined printing color selected from the plurality of the printing color is performed within the non-drawing area of the photoconductor drum.

According to this invention, using the non-drawing area, the main body of the developing device and the developing rollers shift their positions, so that their movements do not affect on the drawing. Therefore, the drawing movement can be smoothly and rapidly shifted from one color to the next color. The drawing area and the non-drawing area are present, so that it is possible to adapt to the various sizes of the printing paper as the range of the non-drawing area can be varied if required. Therefore, the printing apparatus having one photoconductor drum and one transfer roller is capable of printing on various kinds of printing paper, so that the manufacture and arrangement of the photoconductor drum or the like can be easily performed.

In the printing apparatus of the present invention, preferably, the transfer roller is formed so as to be attachable/detachable to the photoconductor drum and the backup roller is formed so as to be attachable/detachable to the transfer roller, where the transfer roller is being detached from the photoconductor drum until the development of the photoconductor drum by the developing means is completed, while the backup roller is being detached from the transfer roller until the printing paper is placed between the backup roller and the transfer roller.

According to this invention, the development of multi-color printing on the surface of the photoconductor drum 2 can be performed without any obstruction and the backup roller 21 does not obstruct the paper feed, so that the printing can be performed smoothly.

In the printing apparatus of the present invention, preferably, the photoconductor drum, the transfer roller, and the backup roller perform their respective rotary motions under the controls of the control means such that their phases are synchronized with each other.

According to this invention, the transfer roller, and the backup roller can be rotated with their phases in synchronism with each other under the controls of the control means, respectively. Therefore, there is no displacement of drawing positions, so that a high-quality printing can be attained.

In the printing apparatus of the present invention, preferably, each of the developing rollers being arranged in each of the plurality of toner storage chambers is independently capable of adjusting a distance from the photoconductor drum.

According to this invention, each of the first, second, third, and fourth developing rollers individually mounted on the respective toner storage chambers is capable of independently adjusting the distance with the photoconductor drum 2, so that it is possible to absorb errors in the manufacture of each developing roller and errors in the installation. Therefore, each of the developing rollers is able to keep the distance at a constant, so that the high quality printing can be attained.

A second aspect of the present invention is a laser output control device to be used in a wet-type electrophotographic printing apparatus having a photoconductor drum with a surface on which an image is formed, a charging means for charging the surface of the photoconductor drum, an exposure means for preparing an electrostatic latent image by irradiating a laser beam on the surface of the photoconductor drum, and a developing means for developing the electrostatic latent image on the surface of the photoconductor drum by stacking a plurality of colors thereon, comprising: a laser output data memory part for storing laser output data for each color of every combination of the plurality of colors; a color combination data memory part for storing drawing data as color combination data for each of pixels; a laser control part for controlling the laser beam by selecting laser output data corresponding to a color to be drawn, wherein the laser control part selects the color to be drawn from the color combination data in the color combination data memory part, selects a pixel including the color to be drawn, selects a pixel having the same color combination as that of the selected pixel from the laser output data memory part, together with selecting the same color as the color to be drawn from the pixel, and provides the laser output data corresponding to the selected color as laser output data of the color to be drawn.

According to this invention, the output level of laser for drawing color from the laser output control device allows the selection of color to be drawn from the color combination data and the selection of pixel in which color to be draw is incorporated. A pixel having color corresponding to the selected pixel is selected from the laser output data memory part and is then provided as laser output data of color to be drawn, so that the power of laser can be varied depending on whether colors are stacked one after another or not, or depending on the other conditions. Consequently, a clear image can be obtained. In addition, the output level of color to be drawn may be defined with reference to the laser output memory part. The laser output data corresponds to drawing data of color combinations in which drawing data is prepared for each pixel. Therefore, for example, there is no need to provide 8 bits of data for one dot to be required in 256 levels of gradation. Therefore, the capacity of the recording device for storing laser output data can be reduced.

In the laser output control device of the present invention, preferably, the plurality of colors includes at least two colors.

According to this invention, a multi-color printing can be attained, so that it will adapt to better meet various customers' needs.

A third aspect of the present invention is to a method of laser output control in a wet-type electro photographic printing apparatus having a photoconductor drum with a surface on which an image is formed, a charging means for charging the surface of the photoconductor drum, an exposure means for preparing an electrostatic latent image by irradiating a laser beam on the surface of the photoconductor drum, and a developing means for developing the electrostatic latent image on the surface of the photoconductor drum by stacking a plurality of colors thereon, where the laser beam is controlled by a laser control part, comprising the steps of: storing laser output data for each color of every combination of the plurality of colors in a laser output data memory part; storing drawing data as color combination data for each of pixels in a color combination data memory part; selecting the color to be drawn from the color combination data in the color combination data memory part by the laser control part; selecting a pixel having the same color combination as that of the selected pixel from the laser output data memory part, together with selecting the same color as the color to be drawn from the pixel; and providing the laser output data corresponding to the selected color as laser output data of the color to be drawn.

According to this invention, just as in the case of the above laser output control device, laser power can be varied depending on whether colors are stacked or not or depending on the change in conditions. Thus, the capacity of the recording device for storing laser output data can be reduced.

A fourth aspect of the present invention is a printing register control device having a photoconductor drum with a surface on which an image is formed, a charging means for charging the surface of the photoconductor drum; an exposure means for preparing an electrostatic latent image by drawing with an exposure scanning on the surface of the photoconductor drum after the charging with the charging means on the basis of drawing data, a developing means for developing the electrostatic latent image on the surface of the photoconductor drum by sequentially supplying multi-color liquid toners on the surface of the photoconductor drum by electrophoresis after the exposure scanning of the exposure means, a transfer roller for receiving the image after the development with the developing means, a backup roller for transferring the image on the transfer roller to the printed paper, and a control means for controlling each of these means and each of these rollers, comprising: a drawing synchronization signal interface circuit for outputting a drawing synchronization signal to an exposure signal outputted to the exposure means; an encoder for detecting a rotation angle of the photoconductor drum; a temporary drawing trigger signal generation part for providing the exposure means with a position on which a drawing initiation trigger signal is generated, by a rotation angle detection signal outputted from the encoder; a first color initial rotation angle memory part for storing an initial rotation angle of the photoconductor drum at the time of detecting a first drawing synchronization signal outputted from the drawing synchronization signal interface circuit after the generation of a temporary drawing trigger signal for the first color; a N-th color initial rotation angle memory part for storing an initial rotation angle of the photoconductor drum at the time of detecting a first drawing synchronization signal outputted from the drawing synchronization signal interface circuit after the generation of a temporary drawing trigger signal for the second or subsequent color; a phase difference calculation part for calculating a phase difference between an initial rotation angle of the photoconductor drum stored in the first color initial rotation angle memory part and an initial rotation angle of the photoconductor drum stored in the N-th color initial rotation angle memory part; and a phase difference correction circuit for correcting the phase difference until an actual drawing initiation synchronization signal is generated on the basis of the result of calculation from the phase difference calculation part.

According to this invention, the phase difference between the initial rotation angles of the photoconductor drum stored in the first color initial rotation memory part and the N-th color initial rotation angle memory part is calculated at the phase difference calculation part. Depending on the results of such a calculation, the correction for changing the rotation speed of the photoconductor drum by the phase difference correction circuit during the time period until a synchronization signal for initiating an actual drawing is generated. Therefore, the initiation of actual drawing of fist color always corresponds to that of second or other color, so that the register of each color can be maintained at a high level when multi-color printing is performed. As a result, the printing material with a high quality can be obtained.

In this invention, preferably, the photoconductor drum is actuated by a servo motor and a feedback encoder signal from the servo motor is used together with the rotation angle detection encoder of the photoconductor drum.

According to this invention, two different functions can be attained by one encoder, so that the number of components to be used can be reduced.

In this invention, preferably, a time period from a first drawing synchronization signal after the generation of the first color temporary drawing trigger signal to a fist color actual drawing initiation synchronization signal is an integral multiple of a cycle of exposure scanning.

According to this invention, the time period from an initial synchronization signal after the generation of first color temporary drawing trigger signal to a synchronization signal of fist color actual drawing initiation is an integral multiple of a cycle of exposure scanning movement, so that there is no output of the synchronization signal of actual drawing initiation during the exposure scanning. Therefore, each color can be registered more perfectly.

A fifth aspect of the present invention is a printing method for bringing a developing roller in close to a photoconductor drum having a surface on which an electrostatic latent image is formed, and rotating the developing roller to supply liquid toner, which is supplied on the surface of the developing roller such that at least the surface of the developing roller is wet with the liquid toner, on the surface of the photoconductor drum by electrophoresis to develop the electrostatic latent image, comprising the step of: rotating the developing roller before the development of the electrostatic latent image by supplying the liquid toner, where the rotation speed of the developing roller before the development of the electrostatic latent image is faster than the rotation speed of the developing roller during the development of the electrostatic latent image.

In this invention, the developing roller is brought in close to the photoconductor drum and is rotated to supply the liquid toner supplied on the surface of the developing roller to the photoconductor drum by electrophoresis. Before the development of the electrostatic latent image by supplying the liquid toner, the rotation speed of the developing roller before the development of the electrostatic latent image is faster than the rotation speed of the developing roller during the development of the electrostatic latent image. Therefore, the amount of liquid toner to be supplied between the photoconductor drum and the developing roller becomes increased, so that meniscus can be quickly formed when the change of colors takes place, so that a stable development can be attained and the image quality can be improved.

A sixth aspect of the present invention is a printing method for bringing one of developing rollers corresponding to a color component in close to a photoconductor drum having a surface on which a plurality of electrostatic latent images is formed for every color component, and rotating the developing roller to supply liquid toner corresponding to the color component, which is supplied on the surface of the developing roller such that at least the surface of the developing roller is wet with the liquid toner, on the surface of the photoconductor drum by electrophoresis to develop the electrostatic latent image, comprising the step of: rotating the developing roller before the development of the electrostatic latent image by supplying the liquid toner, where the rotation speed of the developing roller before the development of the electrostatic latent image is faster than the rotation speed of the developing roller during the development of the electrostatic latent image.

In this invention, the developing roller corresponding to an electrostatic latent image formed for every color component is brought in close to the photoconductor drum and is rotated to supply the liquid toner supplied on the surface of the developing roller to the photoconductor drum by electrophoresis. Before the development of the electrostatic latent image by supplying the liquid toner, the rotation speed of the developing roller before the development of the electrostatic latent image is faster than the rotation speed of the developing roller during the development of the electrostatic latent image. After passing the predetermined time period, then the developing roller is decelerated to the rotation speed thereof at the time of development. Therefore, if another developing roller is brought in close to the photoconductor drum for changing the liquid toner to another one, the amount the amount of liquid toner to be supplied between the photoconductor drum and the developing roller becomes increased, so that meniscus can be quickly formed when the change of colors takes place, so that a stable environment conditions can be attained together with attaining stable developmental conditions, resulting in the improvement in the image quality.

It is preferable that after rotating the developing roller at the faster speed, the developing roller is decelerated to the rotation speed thereof at the time of the development until the development is performed.

Accordingly, after rotating the developing roller at the faster speed, the developing roller is decelerated to the rotation speed thereof at the time of the development until the development is performed. Therefore, it is possible to avoid the problem in which an unstable development is occurred by an excess supply of liquid toner between the photoconductor drum and the developing roller as a result of insufficient deceleration of the developing roller. Therefore, the decrease in printing quality can be substantially prevented.

A seventh aspect of the present invention is a printing apparatus comprising: a photoconductor drum having a surface on which an electrostatic latent image is formed; a developing roller provided in a rotatable manner such that at least the surface of the developing roller is wet with liquid toner, and developing the electrostatic latent image by supplying the liquid toner on the surface of the photoconductor drum by electrophoresis while keeping a rotary motion of the developing roller; and a control means for controlling the rotation speed of the developing roller such that the rotation speed of the developing roller before the development of the electrostatic latent image by supplying the liquid toner is faster than the rotation speed of the developing roller during the development of the electrostatic latent image.

According to this invention, the control means imparts a rotary motion of the developing roller to supply the liquid toner supplied on the surface of the developing roller to the photoconductor drum by electrophoresis. Before the development of the electrostatic latent image by supplying the liquid toner, the rotation speed of the developing roller before the development of the electrostatic latent image is faster than the rotation speed of the developing roller during the development of the electrostatic latent image. Therefore, the amount of liquid toner to be supplied between the photoconductor drum and the developing roller becomes increased, so that meniscus can be quickly formed when the change of colors takes place, so that a stable development can be attained and the image quality can be improved.

In this invention, preferably, after rotating the developing roller at the faster speed, the developing roller is decelerated to the rotation speed thereof at the time of the development until the development is performed.

Accordingly, after rotating the developing roller at the faster speed, the developing roller is decelerated to the rotation speed thereof at the time of the development until the development is performed. Therefore, it is possible to avoid the problem in which an unstable development is occurred by an excess supply of liquid toner between the photoconductor drum and the developing roller as a result of insufficient deceleration of the developing roller. Therefore, the decrease in printing quality can be substantially prevented.

In this invention, preferably, a plurality of the developing rollers is provided depending on the kinds of the liquid toner, a moving means is provided on a position where one of the plurality of the developing rollers is brought in close to the photoconductor drum to allow the formation of meniscus of the liquid toner placed between the developing roller and the photoconductor drum and another moving means is provided on a position where the developing roller is moved away from the photoconductor drum to prevent the formation of meniscus of the liquid toner, and the control means controls the rotation speed of the developing roller such that the rotation speed of the developing roller before the development of the electrostatic latent image by supplying the liquid toner after closing to the photoconductor drum by the moving means is faster than the rotation speed of the developing roller during the development of the electrostatic latent image.

In this invention, the moving means moves the developing roller away from the photoconductor drum, shifting into a state of preventing the formation of meniscus of the liquid toner placed between the developing roller and the photoconductor drum. At this time, if another developing roller corresponding to another liquid toner is brought in close to the photoconductor drum for the purpose of supplying another liquid toner, the rotation speed of the developing roller is increased until the development is performed. Thus, the rotation speed of the developing roller before the development of the electrostatic latent image is faster than the rotation speed of the developing roller during the development of the electrostatic latent image. In the case of using several kinds of liquid toners in the development, meniscus of each liquid toner can be quickly formed when the change of colors takes place. Thus, a stable environment conditions can be attained together with attaining stable developmental conditions, resulting in the improvement in the image quality. In addition, these liquid toners are hardly mixed, so that excellent multi-color printing can be performed without causing undesired mixing of colors, adapting to better meet various customers' needs.

BRIEF DESCRIPTION OF THE DRAWINGS

FIG. 11 is a data diagram in the case of indicating the original image with pixel unit of the above embodiment;

FIG. 14 is a schematic diagram for illustrating the contents of the laser output data memory part of the above embodiment;

DETAILED DESCRIPTION OF THE PREFEERRED EMBODIMENTS

Hereinafter, we will describe a printing apparatus as one of preferred embodiments of the present invention.

Figure 1:
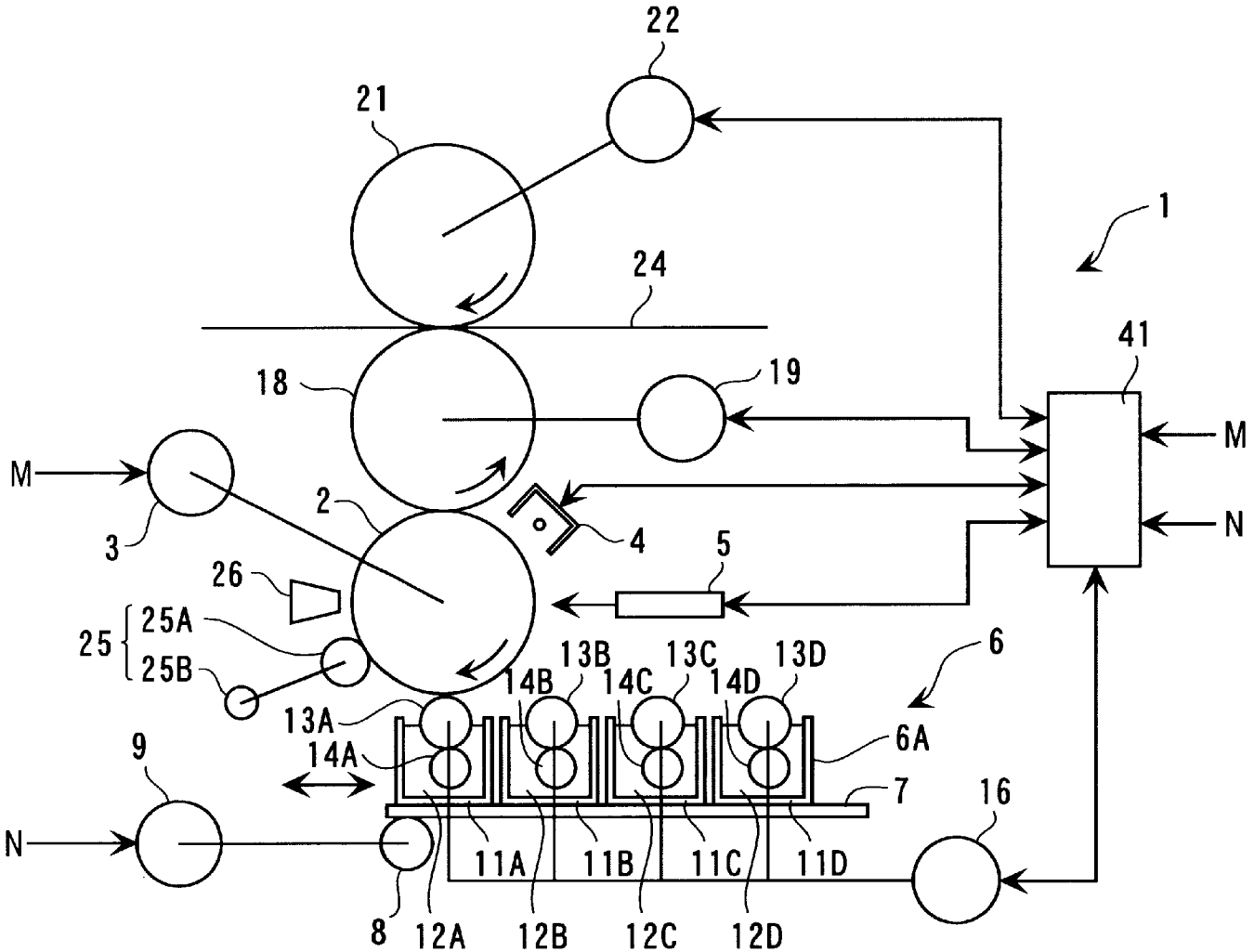
FIG. 1 is a block diagram of one of preferred embodiments of the present invention.

FIG. 1 shows the configuration of a main part of a printing apparatus of the present embodiment. The printing apparatus 1 performs a printing movement in an image-on-image fashion. For example, a drawing data prepared on the basis of printing-image data is used for performing an image formation by successively stacking four colors of yellow, magenta, cyan, and black. In the printing apparatus 1, a photoconductor drum 2 in a generally cylindrical shape is rotatably arranged such that five images can be formed on the outer peripheral surface of the photoconductor drum 2. Also, a first servo motor 3 is mounted on the photoconductor drum 2 and is provided as a driving means for imparting a rotary motion to the photoconductor drum 2 in a predetermined direction.

In the proximity of the photoconductor drum 2, a charging device is positioned and is provided as a charging means for providing the photoconductor drum 2 with its photosensitivity by electro statically charging the surface thereof. Furthermore, an exposure device 5 is positioned in the proximity of the photoconductor drum 2 and is located on the downstream from the charging device 4 in the rotary direction of the photoconductor drum 2. The exposure device 5 forms an electrostatic latent image on the surface of the photoconductor drum 2 by irradiating the charged surface of the photoconductor drum 2 with light such as a beam of laser for a predetermined time period.

As shown in the figure, there is a developing means 6 below the photoconductor drum 6.

The developing means 6 is located on the downstream from the exposure device 5 in the rotary direction of the photoconductor drum 2 and comprises a tabular platform 7. In addition, there is a developing-device moving mechanism 8 arranged on the platform 7. The developing-device moving mechanism 8 is capable of shifting the location of the platform 7 in a horizontal direction. Furthermore, a motor 9 is provided as a means for actuating the developing-device moving mechanism 8 and is connected to the developing-device moving mechanism 8 and is provided. Thus, the platform 7 is allowed to move in a horizontal direction by a driving force of the motor 9 through the developing-device moving mechanism 8. On the top of the platform 7, there are two or more toner storage chambers. In this embodiment, but not limited to, four storage chambers 11A, 11B, 11C, 11D are arranged in series as shown in the figure. Each of these chambers 11A–11D store liquid toners of different colors, respectively. In the toner storage chamber 11A, for example, liquid toner 12A of yellow which is a first color among four process colors may be stored. In the toner storage chamber 11B, liquid toner 12B of magenta which is a second color among four process colors may be stored. In the toner storage chamber 11C, liquid toner 12C of cyan may be stored. In the toner storage chamber 11D, furthermore, liquid toner 12D may be stored.

As shown in FIG. 1, a first developing roller 13A and a first supporting roller 14A are arranged in the toner storage chamber 11A. In other words, the axis of the first developing roller 13A and the axis of the first supporting roller 14A are parallel with each other and extend substantially in a horizontal direction. The first developing roller 13A is located above the first supporting roller 14A, and these rollers 13A, 14A are rotatably supported with their respective axes such that their outer peripheral surfaces can be generally contacted to each other. In the toner storage chamber 11B, similarly, a second developing roller 13B and a second supporting roller 14B are arranged above and below with respect to each other and these rollers 13B, 14B are rotatably supported with their respective axes such that their outer peripheral surfaces can be generally contacted to each other. In addition, a third developing roller 13*c* and a third supporting roller 14*c* are rotatably arranged above and below with respect to each other in the toner storage chamber 11C in an analogous fashion. In the toner storage chamber 11D, furthermore, a fourth developing roller 13D and a fourth supporting roller 14D are rotatably arranged above and below with respect to each other in an analogous fashion.

It is noted that a part of the outer peripheral surface of each of the first, second, third, and fourth developing rollers 13A–13D is positioned so as to be immersed in each of the liquid toners 12A–12D in their respective toner storage chambers 11A–11D.

A developing-device driving motor 16 as a developing-device driving means is mounted on the developing means 6. The developing-device driving motor 16 is connected to a pair of the first developing roller 13A and the first supporting roller 13A; a pair of the second developing roller 13B and the second supporting roller 14B; a pair of the third developing roller 13C and the third supporting roller 14C; and a pair of the fourth developing roller 13D and the fourth supporting roller 14D, respectively.

Figure 9:
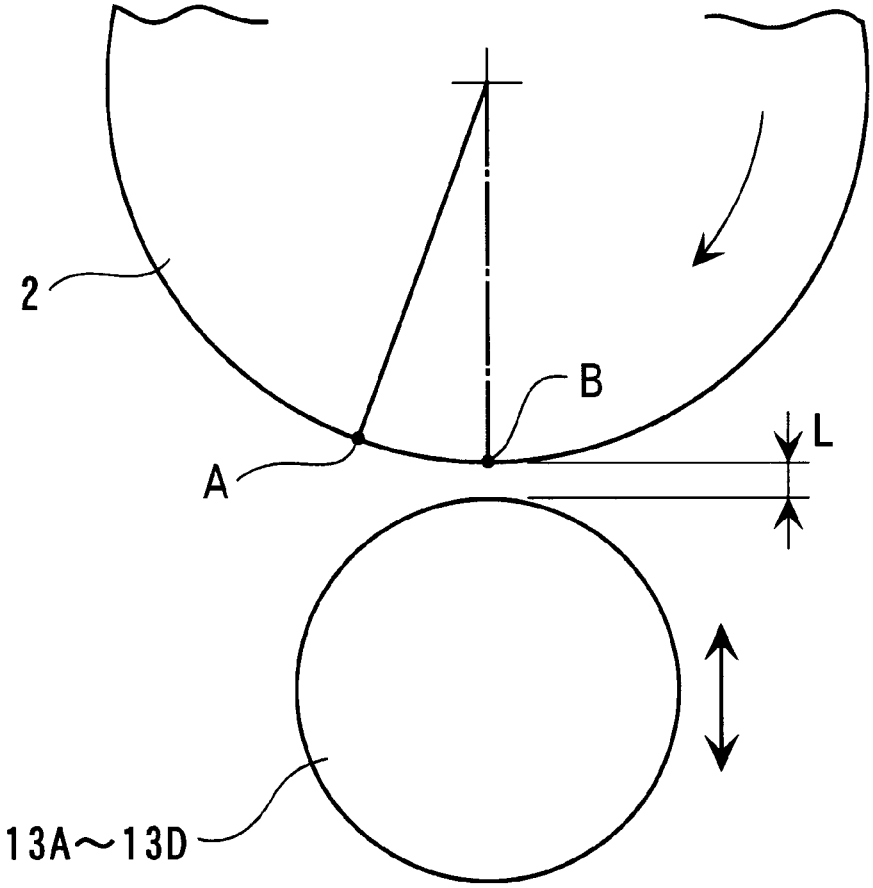
FIG. 9 is a schematic diagram for illustrating the relationship between the photoconductor drum and the developing device.

Each of these pairs can be provided as a unit of rotation. In other words, these pairs are independently rotated in their respective toner storage chambers 11A–11D by actuating the developing-device driving motor 16, respectively. The rotation speeds of the first developing roller 13A and the first supporting roller 14A; the second developing roller 13B and the second supporting roller 14B; the third developing roller 13C and the third supporting roller 14C; and the fourth developing roller 13C and the fourth supporting roller 14D can be varied by controlling the operation of the developing-device driving motor 16, respectively. It is noted that the developing-device driving motor 16 rotates each of the developing rollers 13A–13D in the same rotary direction as that of the photoconductor drum 2. In addition, another motor 16A for adjusting the spacing between the adjacent developing rollers is independently mounted on each of the developing rollers 13A–13D in addition to the developing-device driving motor 16. As shown in FIG. 9, the spacing-adjustment motor 16A permits to adjust the distance L between the photoconductor drum 2 and each of the developing rollers 13A–13D while the developing roller keeps its rotation at a predetermined fixed speed ratio with respect to the photoconductor drum 2.

Here, the above distance L between the photoconductor drum 2 and each of the developing rollers 13A–13D permits the migration of liquid toner by electrophoresis when the developing rollers 13A–13D is brought near to the photoconductor drum 2. In the case of capillary phenomenon, however, such a distance L does not permit the migration of liquid toner. Therefore, the distance L is set to an appropriate one for allowing the formation of a clear image. In addition, the distance L is the extent of space that can be previously calculated depending on the rotation speeds of the photoconductor roller and developing rollers, the properties of liquid toner, and so on the basis of practical and experimental experiences. The result of such a calculation is stored as one of parameters in a memory part 42A.

Then, the developing means 6 actuates the motor 9 to allow the developing-device moving mechanism 8 to shift the platform in a horizontal direction, positioning each of toner storage chambers 11A–11D which corresponds to an electrostatic latent image of each color at a location below the photoconductor drum 2 so as to face to each other.

1 Subsequently, the developing means 6 permits the formation of meniscus between the surface of the photoconductor drum 2 and the surface of the developing roller 13A–13D in the toner storage chamber 11A–11D being positioned at the above downward location facing to the photoconductor drum 2. As a result, the corresponding liquid toner 12A–12D migrates from the photoconductor drum 2 to the developing roller 13A–13D by the phenomenon of electrophoresis. The extent of space between the photoconductor drum 2 and the developing roller 13A–13D depends on the rotation speeds of the photoconductor roller and developing rollers, the properties of liquid toner, and so on, on the basis of practical and experimental experiences and is stored as one of parameters in the memory part 42A.

A transfer roller 18 is placed at a location above the photoconductor drum 2. The transfer roller 18 is formed in a cylindrical shape with substantially the same diameter as that of the photoconductor drum 2. Also, the transfer roller 18 is arranged such that it rotates around its rotation axis substantially in parallel with the rotation axis of the photoconductor drum 2. In addition, a second servo motor 19 is concentrically arranged on the transfer roller 18 and is provided as a driving means for allowing rotation of the transfer roller 18 in the direction corresponding to the rotary direction of the photoconductor drum 2 so as to be rotated in synchronism therewith.

The transfer roller 18 has its outer peripheral surface being press-contact to the outer peripheral surface of the photoconductor drum 2 to allow the transfer of image developed and formed on the surface of the photoconductor drum 2 to the surface of the transfer roller 18. Also, but not shown in the figure, there is an actuator mounted on the transfer roller 18. The actuator is responsible for bring the transfer roller 18 into contact with the photoconductor drum 2 and moving the transfer roller 18 away from the photoconductor drum 2.

Furthermore, there is a generally cylindrical-shaped backup roller 21 positioned above the transfer roller 18. The backup roller 21 is arranged so as to be rotatable in the direction substantially parallel with the rotation axis of the transfer roller 18. In addition, a third servo motor 22 is mounted on the backup roller 21. The third servo motor 22 is a driving means capable of imparting a rotary motion to the backup roller 21 in the direction corresponding to the rotary direction of the transfer roller 18 in synchronism therewith.

Then, the backup roller 21 presses the transfer roller 18 from above to prevent the pressure from escaping with the deformation of the backup roller 21 and to apply a strong pressure over the photoconductor drum 2 from the transfer roller 18. Furthermore, a sheet of printing paper 24 is transferred by a transfer mechanism (not shown). Then, the backup roller 21 allows to place the printing paper 24 between the backup roller 21 and the transfer roller 18 to print an image by pressure-transfer of an image from the transfer roller 18 to the printing paper 24 while feeding the printing paper 24 by the rotary movements of the rollers 18, 21.

There is, but not shown in the figure, an actuator provided on the backup roller 21 for bringing the backup roller 21 into contact with the transfer roller 18 and moving the backup roller 21 away from the transfer roller 18. Also, but not shown in the figure, there is another actuator provided on the above transfer mechanism for mounting and demounting the transfer mechanism.

In the proximity of the photoconductor drum 2, there is a fog-removing means 25 arranged between the developing means 6 and the transfer roller 18 to remove any fog happened to an image after the development using the developing means 6. Also, a drying means 26 is arranged between the fog-removing means 25 and the transfer roller 18 for drying liquid toner on the surface of the photoconductor drum 2 after removing the fog.

As shown in the figure, the fog-removing means 25 comprises a fog-removing roller 25A and a motor 25B that imparts a rotary motion to the roller 25A.

Here, the term "fog" happed to the image refers to a blurred portion of the developed image on the surface of the photoconductor drum 2 with a predetermined thickness or more of liquid toner being attached thereon.

Figure 2:
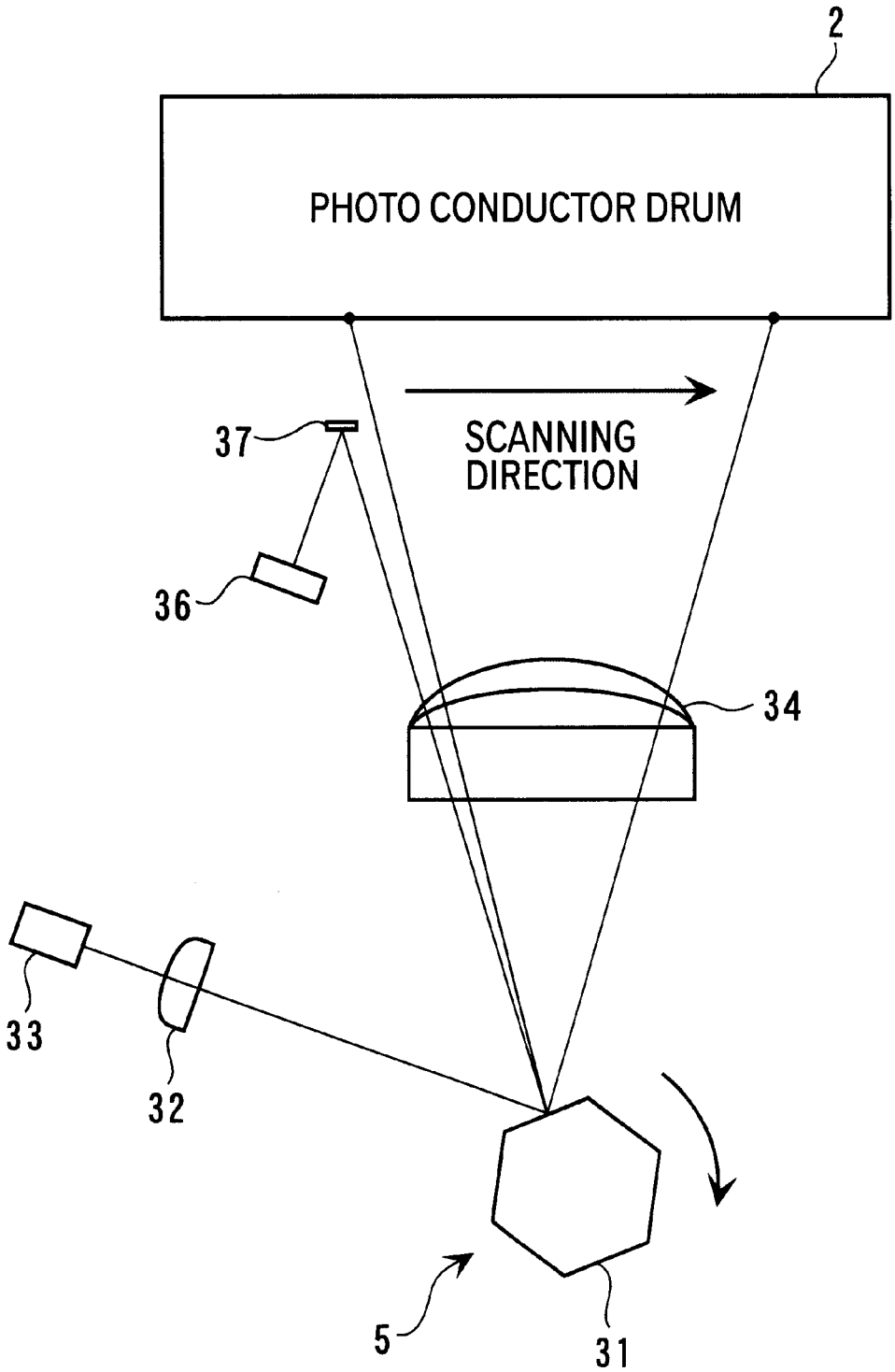
FIG. 2 is a block diagram for illustrating the exposure device of the above embodiment.

Furthermore, as shown in FIG. 2, the exposure device 5 comprises a polygon scanner 31 capable of rotate at a constant speed. The polygon scanner 31 has a laser diode 33 for introducing a beam of laser into the polygon scanner through a lens 32. In the exposure deice 5, moreover, there is an fθ lens 34 on which the laser beam from the polygon scanner 31 can be converged. The laser beam outputted from the laser diode 33 is introduced into the polygon scanner 31 and is then reflected toward the photoconductor drum 2 through the fθ lens 34. The laser beam incident upon the surface of the photoconductor drum 2 scans in a systematic pattern over the surface.

Figure 3:
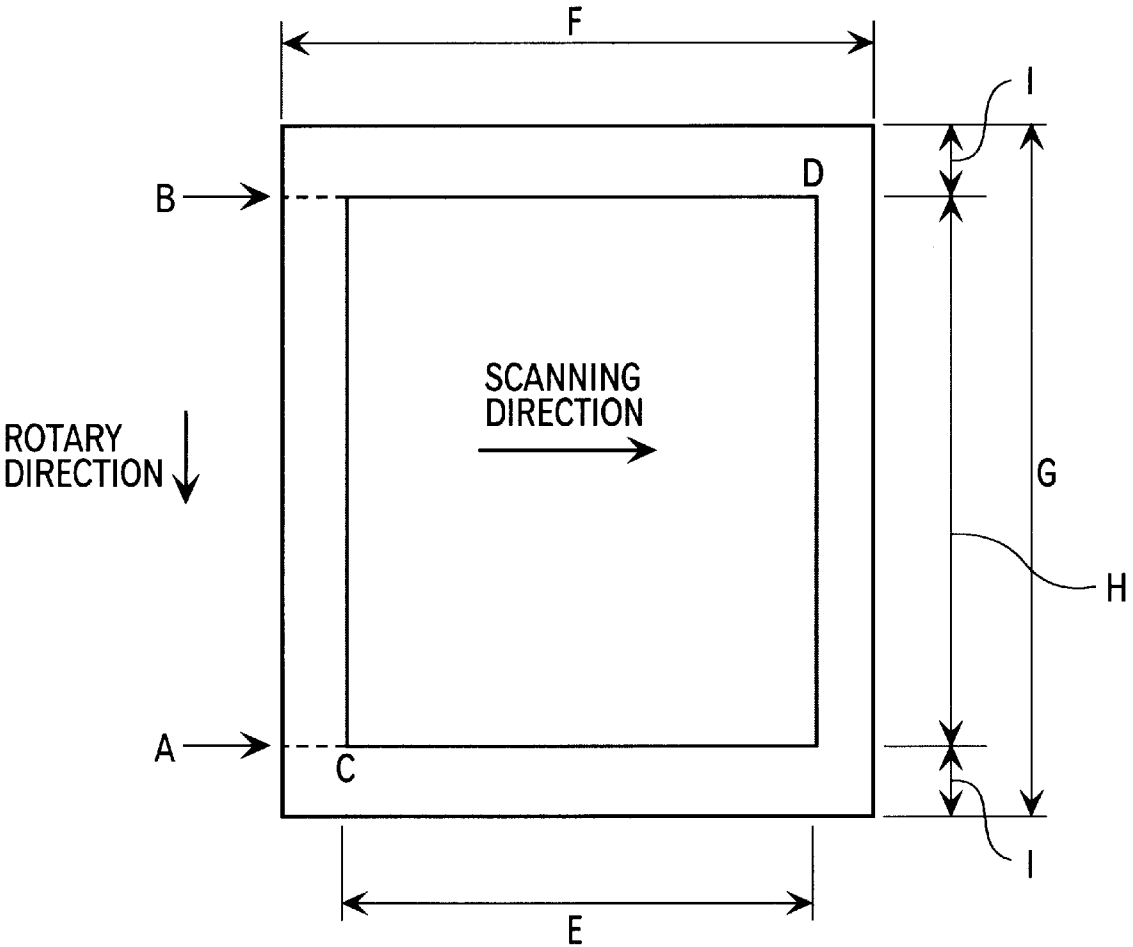
FIG. 3 is an explanation diagram for illustrating the conditions of drawing on the photoconductor drum of the above embodiment.

As shown in FIG. 3, a drawing area H with predetermined dimensions is formed on the center of circumference G, i.e., the length of the photoconductor drum 2 in a circumferential direction. In addition, as shown in the figure, non-drawing areas I are formed on both circumferential end portions of the photoconductor drum 2. Also, an drawing start line A is defined on one side of the drawing area H, adjacent to one of non-drawing areas I, and an drawing end line B is defined on the other side of the image area H, adjacent to the other of the non-drawing areas I.

On the other hand, the scanning width E of the drawing are H to be scanned by the polygonal scanner 31 is defined with respect to the width F of the photoconductor drum 2 in its axial direction. Then, an end of the drawing start line A, i.e., a scanning start line, is defined as an drawing original point C, while the other end of the final drawing line B, i.e., a scanning end line, is defined as an drawing complete point D. Then, an encoder detection angle of the drawing original point C is additionally stored in the memory part 42A.

In the exposure device 5, furthermore, there is a synchronization-detecting photodetector 36 for detecting light and a mirror 37 for reflecting a laser beam from the polygon scanner 31 to the laser diode 33 through the fθ lens 34. Subsequently, the photodetector 36 detects the laser beam to recognize a timing of the synchronization.

Next, we will describe the internal configuration of the printing apparatus of the above embodiment with reference to the figures.

Figure 4:
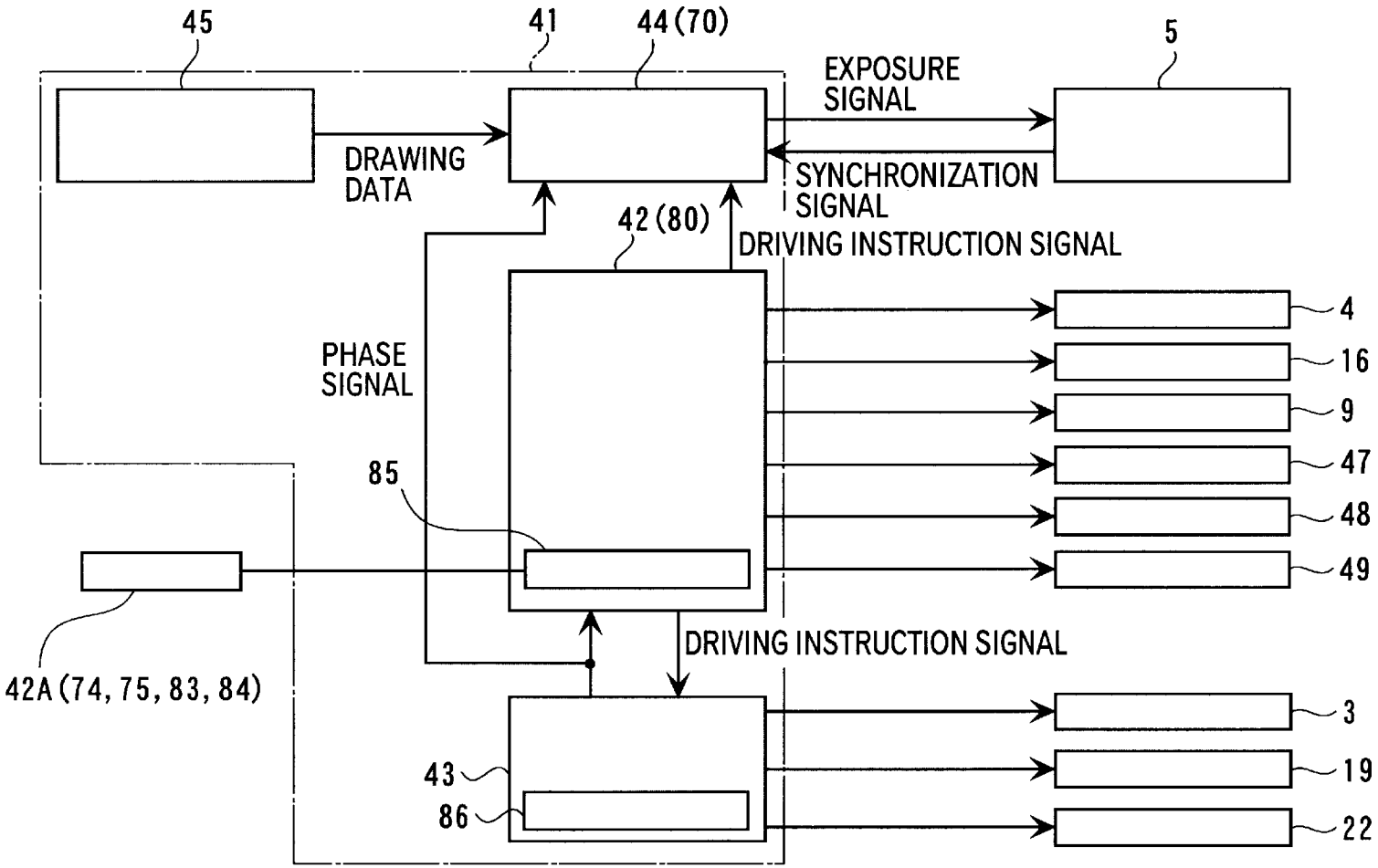
FIG. 4 is a block diagram for illustrating the control device of the above embodiment.

In FIG. 4, the printing apparatus 1 comprises, for example, a plurality of print-circuit boards on which a plurality of electric parts and a control means 41 for controlling all of them. The control means 41 comprises: a process control part 42, a phase-synchronization control part 43 connected to the process control part 42, an exposure control part 44 connected to the process control part 42 and the phase-synchronization control part 43, and an drawing data preparation part 45 connected to the exposure control part 44.

The process control part 42 transmits a driving-instruction signal to the phase-synchronization control part 43 to actuate such a part 43. Also, the process control part 42 transmits a driving-instruction signal to the exposure control part 44 to actuate such a part 44. Furthermore, the process control part 42 is connected to and actuates a charging device 4, a developing-device driving motor 16, a developing-device moving motor 9, a transfer-roller detachable/attachable actuator 47, a backup-roller detachable/attachable actuator 48, and a paper-feed actuator 49, respectively. Moreover, the process control part 42 comprises a memory part 42A and a timer means (not shown) for measuring time intervals.

During the development of an electrostatic latent image on the photoconductor drum 2, there are three time periods, i.e., t0, t1, and t. These time periods t0, t1, t can be measured using the timer means equipped on the process control part 42, or recognized from the rotary phases of the rotating photoconductor drum 2, or the like.

The time period t0 ranges from the time of completing development of the final drawing line B to the time of starting a printing, corresponding to a time period of waiting for meniscus formation, during which meniscus is not formed between the photoconductor drum 2 and one selected from the first, second, third, and fourth developing rollers 13A–13D because of moving the platform 7 away from the photoconductor drum 2 such that the selected roller cannot face to the photoconductor drum 2.

Also, the time period t1 corresponds to a time period of meniscus formation but not correspond to a time period of electrostatic latent image formation. That is, one selected from the first, second, third, and fourth developing rollers 13A–13D is located at a place facing to the photoconductor drum 2, but not located to at place facing to the drawing original point C on the drawing start line A.

Furthermore, the time period t1 corresponds to a time period of developing an electrostatic latent image as the drawing original point C arrives at a developing position.

The driving control of the developing-device driving motor 16 is performed as follows. That is, during the time periods t0 and t1, the driving motor 16 imparts a rotary motion to one selected from the first, second, third, and fourth developing rollers 13A–13D at a rate of normal development V. During the time period t, on the other hand, the driving motor 16 imparts a rotary motion to the selected roller at a rate of meniscus formation Vm which is higher than the rate of normal development V.

A phase-synchronization control part 43 comprises: a digital signal processor (DSP) part 51 that acts as an integrated control part; three servo controllers, i.e., first, second, and third servo controllers 52, 53, 54, connected to the DSP part 51, respectively; and an input/output interface connected to the DSP part 51.

The first servo controller 52 is connected to the first servo motor 3 through a first servo amplifier 57. The second servo controller 53 is connected to the second servo motor 19 through a second servo amplifier 58. Furthermore, the third servo controller 54 is connected to the third servo motor 22 through a third servo amplifier 59.

In addition, the first servo motor 3 is connected to a first encoder 61 to be connected to the first servo controller 52. The second servo motor 19 is connected to a second encoder 62 to be connected to the second servo controller 53. Furthermore, the third servo motor 22 is connected to a third encoder 63 to be connected to the third servo controller 54.

The DSP part 51 is capable of simultaneously transmitting individual position-instruction (rotation angle) signals to the first, second, and third servo controllers 52, 53, 54, respectively.

The position-instruction signals transmitted to the first, second, and third servo controllers 52, 53, 54 are further transmitted to the corresponding first, second, and third servo amplifiers 57, 58, 59, respectively. Then, each of the first, second, and third servo amplifiers 57, 58, 59 converts the transmitted position-instruction signal into a driving signal and then outputs the driving signal to the corresponding first, second, or third servo motor 3, 19, 22.

Furthermore, the driving signals transmitted from the respective servo amplifier 57, 58, 59 appropriately actuate the first, second, and third servo motors 3, 19, 22, respectively. In addition, the first, second, and third encoders 61, 62, 63 are actuated to transmit their feedback signals to the corresponding first, second, and third servo controllers 3, 19, 22, respectively.

Each of the first, second, and third servo motors 3, 19, 22 has a software-servo mechanism for controlling each servo system by constructing a positioning loop with a fixed cycle (servo-based sampling cycle).

In addition, the DSP part 51 keeps the time intervals depending on the speed instruction at the time of operation at a constant speed and sequentially transmits position-instruction signals to the first, second, and third servo controllers 52, 53, 54, respectively. At this time, by means of software-synchronization of the DSP part 51, the photoconductor drum 2, the transfer roller 18, and the backup roller 21 are kept in synchronism with each other. At the time of acceleration or deceleration, the DSP part 51 sequentially transmits position-instruction signals while keeping the rate of change in predetermined angular acceleration depending on the acceleration time or the deceleration time. Then, the software-synchronization of the DSP part 51 maintains the synchronized movements of photoconductor drum 2, transfer roller 18, and backup roller 21.

An input/output interface 55 of the phase-synchronization control part 43 permits the transmission and reception of drive-instruction signals and phase signals between the DSP part 51 and the process control part 42 and also permits the transmission of phase signals from the DSP part 51 to the exposure control part 44.

The DSP part 51 performs a calculation of a position instruction (rotation angle) to the servo controller 54 for the backup roller 21 from a position instruction (rotation angle) to the first servo controller 52 for the photoconductor drum 2 and a calculation of a position instruction (rotation angle) to the servo controller 54 from a position instruction (rotation angle) to the second servo controller 53 to the transfer roller 18. The calculation is performed using the diameter of the backup roller 21 previously defined as a parameter in the memory part 42 of the process control part 42, a change speed ratio between the backup roller 21 and the third servo motor 22, and a speed ratio between the transfer roller 18 and the second servo motor 19.

Variables are defined as follows:

Db: the diameter of backup roller;

Gb: the change speed ratio between the backup roller and the servo motor for such a backup roller;

Nm: the number of rotations of servo motor for the backup roller;

Dt: the diameter of transfer roller;

Gt: the change speed ratio between the transfer roller and the servo motor for such a transfer roller;

N: the number of rotations of servo motor for the transfer roller (=position instruction for transfer roller's servo roller: instruction that provides a change in position per unit hour); and V: peripheral speed.

The peripheral speed (web speed) of the peripheral surface of the transfer roller using the above variations can be represented by the following equation.

$$V=N\cdot Gt\cdot\pi Dt \quad (1)$$

In addition, the peripheral speed of the peripheral surface of the transfer roller is equal to the peripheral speed of the transfer roller, so that it can be represented by the following equation.

$$V=N\cdot Gb\cdot\pi Db \quad (2)$$

Then, the following equation can be derived from the above equations (1) and (2).

$$Nm=NxGt\cdot Dt/Gb\cdot Db$$

From this equation, it becomes evident that a position-instruction (rotation angle) signal (instruction that provides the position change per unit time) to be "N" is provided on the third servo control 54 for the backup roller 21 from a position-instruction (rotation angle) signal to be supplied to the second servo controller 53 for the transfer roller 18.

Then, the first servomotor 3 imparts a rotary motion to the photoconductor drum 22 and then the rotation angle of the photoconductor drum 2 can be recognized with an output from the first encoder 61, causing each of printing movements.

On the other hand, the drawing-data preparation part 45 prepares a drawing data for image formation on the basis of printing-image data. For example, a desktop publishing (DTP) system, which is a system for editing, printing, and publication using a personal computer or a small computer system (e.g., work station), can be used for preparing image data from printing-image data. The prepared drawing data can be outputted in the form of, such as post script (PS) file, portable document format (PDF) file, or tagged image file format (TIFF) file.

The drawing data preparation part 45 has functionalities corresponding to the respective file formats and each can function can be applied to the preparation of drawing data to be used in the printing apparatus 1. Furthermore, the process using different plates for four colors, raster image processor (RIP) process, and so on can be also performed by the drawing-data preparation part 45 by adapting to a desired file format.

Then, the drawing-data preparation part 45 transmits the prepared drawing data to the exposure control part 44.

The exposure control part 44 is connected to the above exposure device 5.

The exposure control part 44 converts the drawing data from the drawing-data preparation part 45 into an exposure signal for drying the exposure device 5 in response to a drive-instruction signal from the process control part 42. Then, the converted signal is transmitted to the exposure device 5 to control the operation of the exposure device 5. A laser-diode control circuit for controlling the operation of the laser diode 33 and a polygon-scanner control circuit for controlling the operation of the polygon scanner 31 are equipped in the exposure control part 44.

In other words, the process control part 42 transmits a drive-instruction signal to the exposure control part 44 and allows the transmission of an exposure signals from the exposure control part 44 to the exposure device 5. The exposure signal permits an output of laser beam from the laser diode 33 to scan over the photoconductor drum 2.

Figure 7:
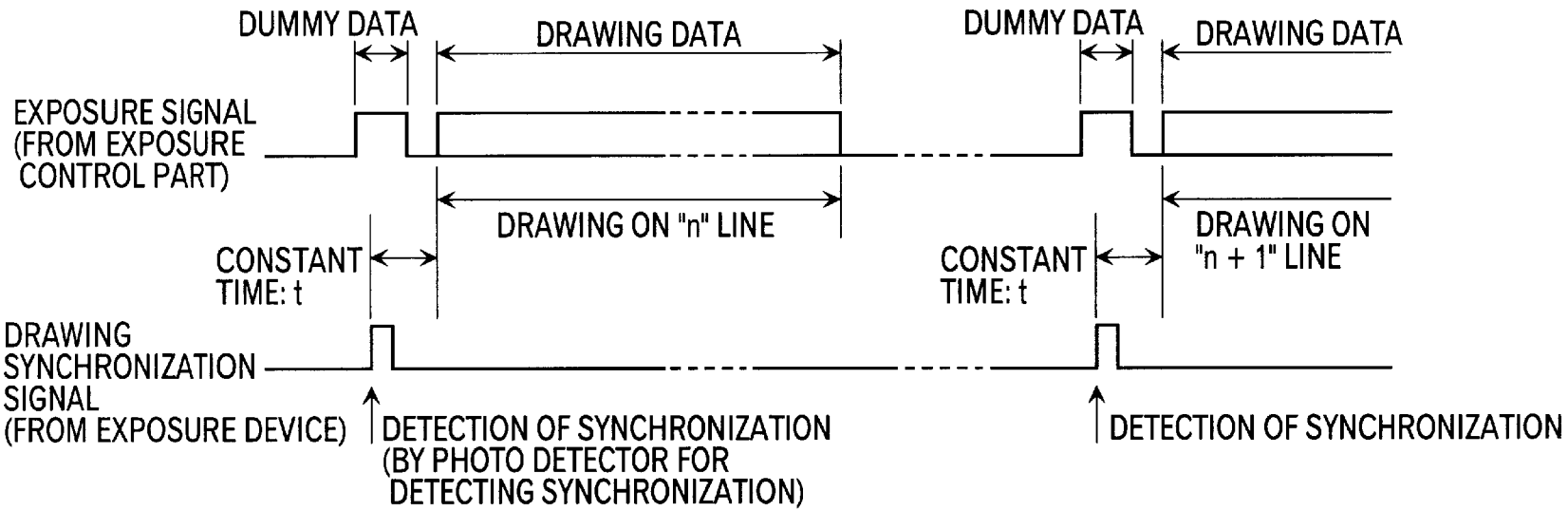
FIG. 7 is an operation chart for illustrating a timing of synchronization of the exposure of the above embodiment.

During the scanning movement, as shown in FIG. 7, for the purpose of synchronism with the drawing position, the process control part 42 outputs a dummy signal through the exposure control part 44 at first. Then, a drawing-synchronization signal is generated from the exposure device in response to the dummy signal. Also, a detection position on which the laser beam reflected again from the mirror 37 is detected by the synchronization-detection photodetector 36 is outputted as a drawing-synchronization signal to the exposure control part 44. After passing a predetermined time period t from the synchronization signal detection position, by the exposure signal being modified on the basis of the drawing-data preparation part 45, the image formation on the surface of the photoconductor drum 2 is initiated, allowing the preparation of drawing data, i.e., the formation of electrostatic latent image.

Figure 10:
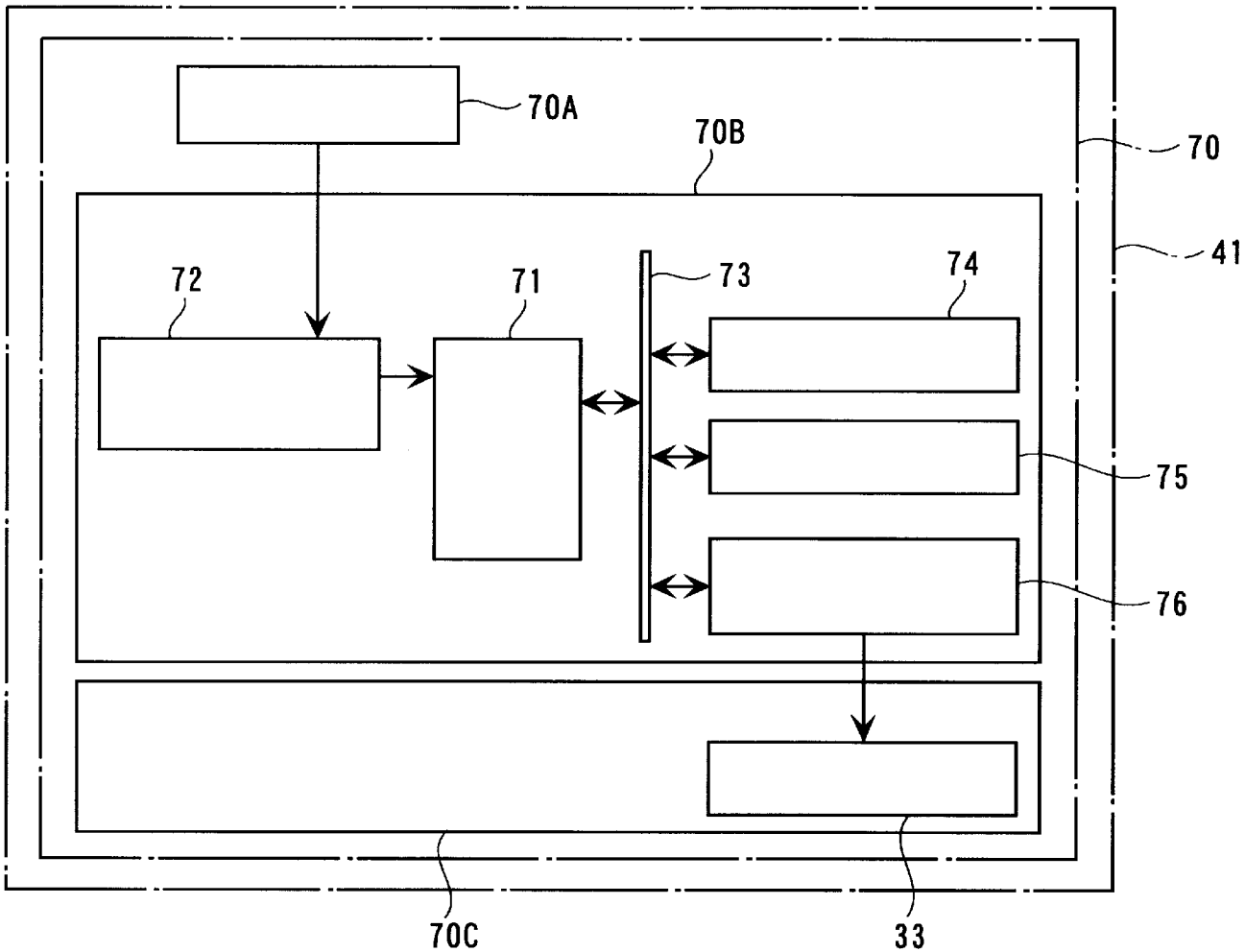
FIG. 10 is a schematic diagram for illustrating the control means of the wet-type electro photographic printing apparatus including the laser output control device.

Here, the exposure control part 44 comprises a laser-output control device 70 for controlling output from the laser diode 33 as shown in FIG. 10.

The laser-output control device 70 comprises a PC part 70 that possesses drawing data to be printed, a main control part 70B, and a laser-driving part 70C. The main control part 70B comprises a CPU part 71 as a laser control part for managing the whole, an interface part 72 for receiving the drawing data, a memory part 74 for a color-combination data in which drawing data can be stored, a memory part, 75 for laser-output data in which output value data of laser corresponding to each color of the color combination can be stored, and a laser-output interface part 75 for transmitting laser output data to the laser driving part 70*c*.

The laser driving part 70C includes the above laser diode 33.

Figure 12:
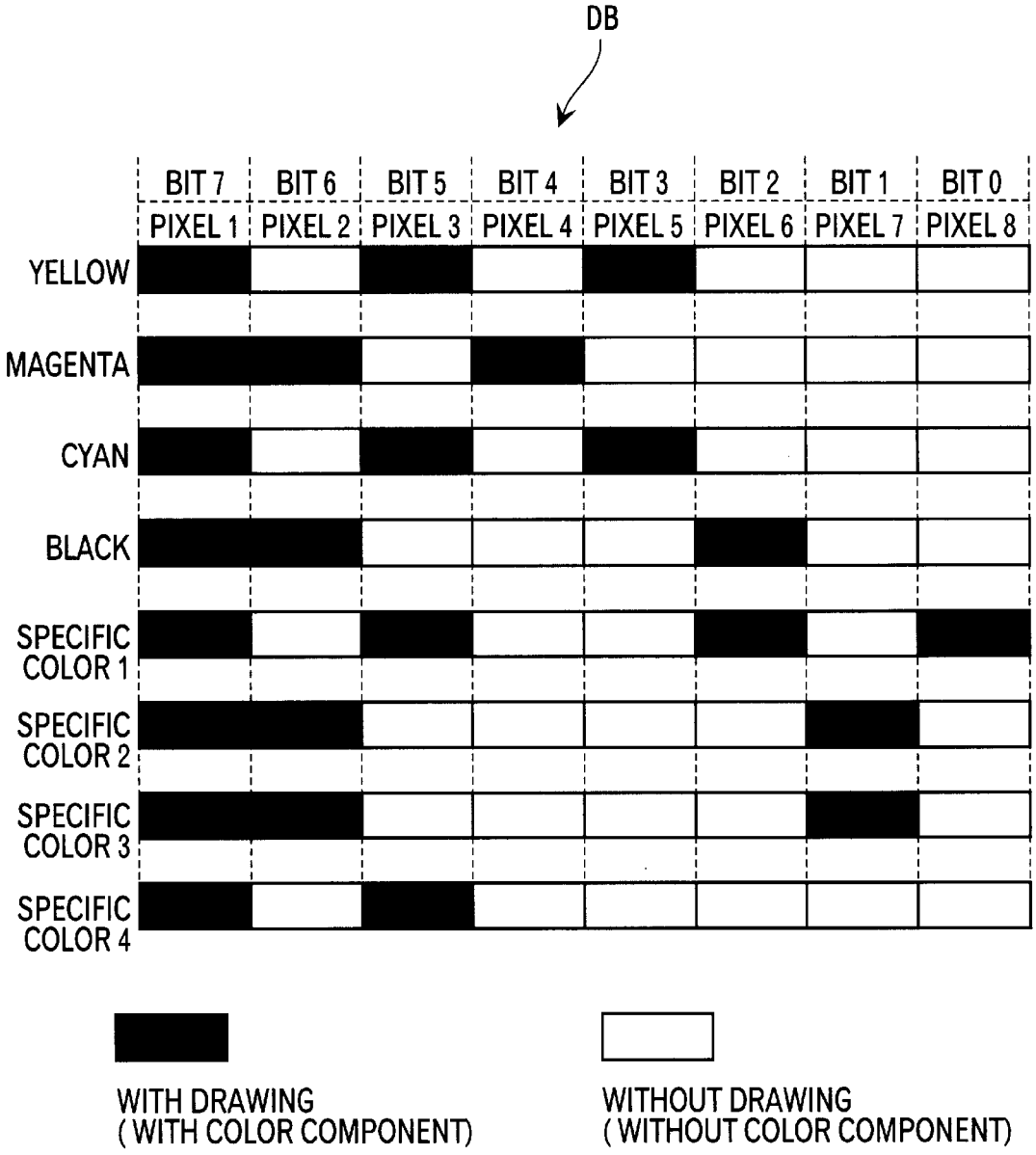
FIG. 12 is a schematic diagram for illustrating data in which each pixel position is defined by every color on the basis of data shown in FIG. 11.

Image data prepared under an external DTP environment is entered into the PC part 70A through the format such as PS, EPS, or PDF. Then, the PC part 70A performs the RIP process. For performing the PIP process, the image data is processed into an appropriate resolution (e.g., 600 dpi, 1000 dpi, 1200 dpi, or 2400 dpi) which is previously instructed, together with the plate-dividing process. Therefore, as shown in FIG. 12, a data base of drawing data is prepared. The data base includes drawing data for yellow (Y), cyan (C), magenta (M), and black (B) and also drawing data for specific colors 1, 2, 3, and 4.

Each data can be prepared as follows.

As shown in FIG. 11, an original image (drawing data) as data to be printed is divided into several data with pixel unit depending on the predetermined resolution, obtaining drawing data DA. In FIG. 11, the direction along the sequence of pixels aligned in a row (i.e., 1, 2, 3,14, 15, 16) is provided as a main-scanning direction. For example, the pixel 1 corresponds to the drawing original point C in FIG. 3, while the pixel 16 corresponds to the drawing-end point D. On the other hand, the sub-scanning direction is the direction along the sequence of pixels aligned in a column (i.e., 1, 17, 33, . . . 113, 129, 145).

The drawing data as shown in FIG. 12 is prepared from the original image using the PIP process and the plate-dividing process. The original image is expressed with the above pixel unit and each pixel is defined such that if it contains one of color components Y, M, C, and K then it is defined as "1" while if not then it does not contain any color component then it is defined as "0", and is then placed its position to obtain the drawing data shown in FIG. 12.

In the case of preparing the drawing data shown in FIG. 12, each drawing data is constructed on a byte-by-byte basis. In a first byte, i.e., a first sequence of adjacent bits operated as a unit, for example, bit 7 is assigned to pixel 1, bit 6 is assigned to pixel 2, . . . , and bit 0 is assigned to pixel 8. In a second byte, bit 7 is assigned to pixel 9, bit 6 is assigned to bit 10 . . . , and bit 0 is assigned to pixel 16. Likewise, each bit of the subsequent bytes 4 and 5 is assigned to appropriate pixel, completing data as drawing data of each color (one pixel corresponds to one dot). In addition, but not shown in the figure, the specific colors 1 to 4 are also processed just in the case with the above color components.

In the drawing data shown in FIG. 12, a rectangular region filled with black represents a portion of "1" containing one of color components, which is subjected to the image formation. On the hand, a rectangular region filled with white represents a portion of "0" without containing any color component, which is not subjected to the image formation.

For example, Y is drawn on each of the first, third, and fifth pixels and the specific color 3 is drawn on each of the first, second, and seventh pixels.

At this stage for the drawing data, there is a need for determining an output level of laser for 8 bits per pixel of each color (when the resolution of laser output is 256 levels of gradation).

The drawing data of each color prepared as described above is arranged so as to be introduced into an interface part 72 of the main control part 70 from the PC part 70A.

Figure 13:
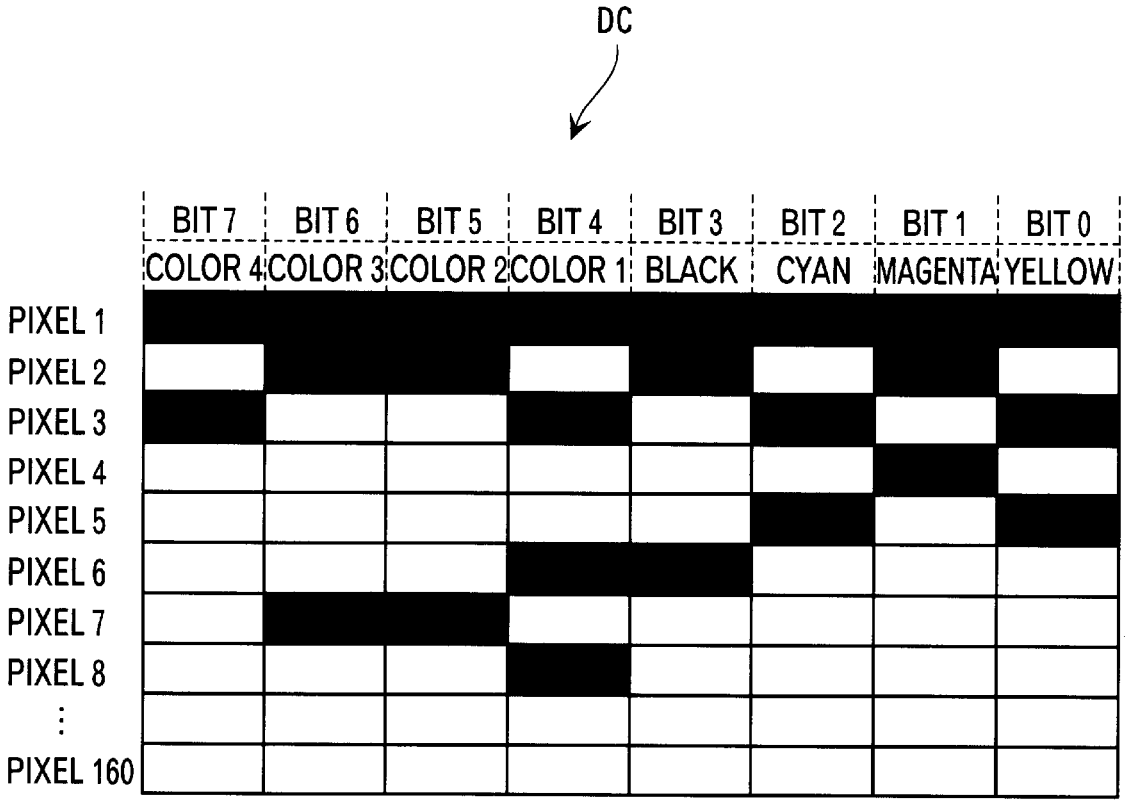
FIG. 13 is a schematic diagram of color combination data in which the data shown in FIG. 1 is changed to the data with the sequence of pixels.

FIG. 13 shows color combination data DC in which the drawing data of FIG. 12 in which pixel positions are defined for each color is converted into data of the sequence of pixels.

The color combination data DC represents the conditions of color combination for each pixel. For example, a first pixel is represented as a color combination of all colors, i.e., Y, M, C, K, and specific colors 1, 2, 3, and 4. Also, for example, a third pixel is represented as a color combination of Y, C, and specific colors 1 and 4. In FIG. 13, there is shown the color combinations for first to eighth pixels. In this embodiment, however, the color combinations for up to 160th pixel can be represented so as to be corresponded with FIG. 11.

The color combination data is edited in the CPU part 71 and is then transmitted to the memory part 74 for storing color image data through a bus.

FIG. 14 shows the contents of a table that constitutes the memory part 75 for storing laser out data.

In this table, there is shown all of the combinations of eight colors in addition to store laser output data DD in which laser output values correspond to the respective colors.

In FIG. 14, 256 table addresses (i.e., 0 to 255) are provided as those of eight colors and listed in the respective output data fields 75A. The output data fields 75B are also listed next to the fields 75A, where output data 0, 100, 120, and so on corresponding to the respective table addresses 0 to 255 are previously defined. A laser output value is individually defined for each color in the output data fields 75B.

The output data is previously defined depending on the rotation speed of photoconductor drum 2, the properties of liquid toner, practical experiences, and so on.

In the method of using such a table, at one of the drawing positions, for example, for rendering Y, if the Y drawing data is "o", then the table address field 75A is filled with "0". If the Y drawing data is "1", then "1" is selected for the table address 75A. Thus, the output data on the address "1", for example 100, is referred.

At the time of drawing M, if the M drawing data is "0", then the table address field 75A is filled with "0", if the M drawing data is "1" and Y is drawn on its pixel position, then "3" is selected for the table address field 75A. Thus, the output data on the address "2", for example 120, is referred.

At the time of drawing C, if the C drawing data is "0", then the table address field 75A is filled with "0", if the C drawing data is "1" and C is drawn on its pixel position, then "5" is selected for the table address field 75A. Thus, the output data on the address "5", for example 230, is referred. In the C drawing data is "1" and Y is drawn on its pixel position and M is also drawn, then "7" is selected for the table address field 75A. Thus, the output data on the address "7", for example 235 is referred. If the C drawing data is "1" and Y is not drawn on its pixel position but M is drawn thereon, then "6" is selected for the table address field 75A. Then, the output data on the address "6", for example 230, is referred.

Subsequently, in an analogous fashion, the color B and the specific colors 1 to 4 are drawn on their pixel positions.

In FIG. 14, furthermore, the table addresses 0 to 18 are listed in the table. However, but not shown in the figure, there are 256 addresses (i.e., 0 to 255) in the table in fact.

In the laser output control device 70, for generating an output of laser to make an electrostatic latent image, the CPU part 71 of the main control part 70B obtains laser output data of color to be drawn, by invoking the color combination data DC such as one shown in FIG. 13 from the memory part 74 for storing color combination data.

At this time, the CPU part 71 selects color to be drawn from color combination data of each color in the memory part 74 and also selects pixel for such a color. Then, the CPU part 71 selects a color combination of selected pixel from the color combinations of each color stored in the memory part 75 for storing laser output data, followed by outputting the laser out put data to the laser output interface part 76.

The laser output data is introduced from the laser output interface part 76 into the laser diode 33 of the laser driving part 70*c*. Then, the predetermined output level of the laser is reflected from the polygon scanner 31 and then scans the surface of the photoconductor drum 2, causing a clear electrostatic latent image.

Figure 15:
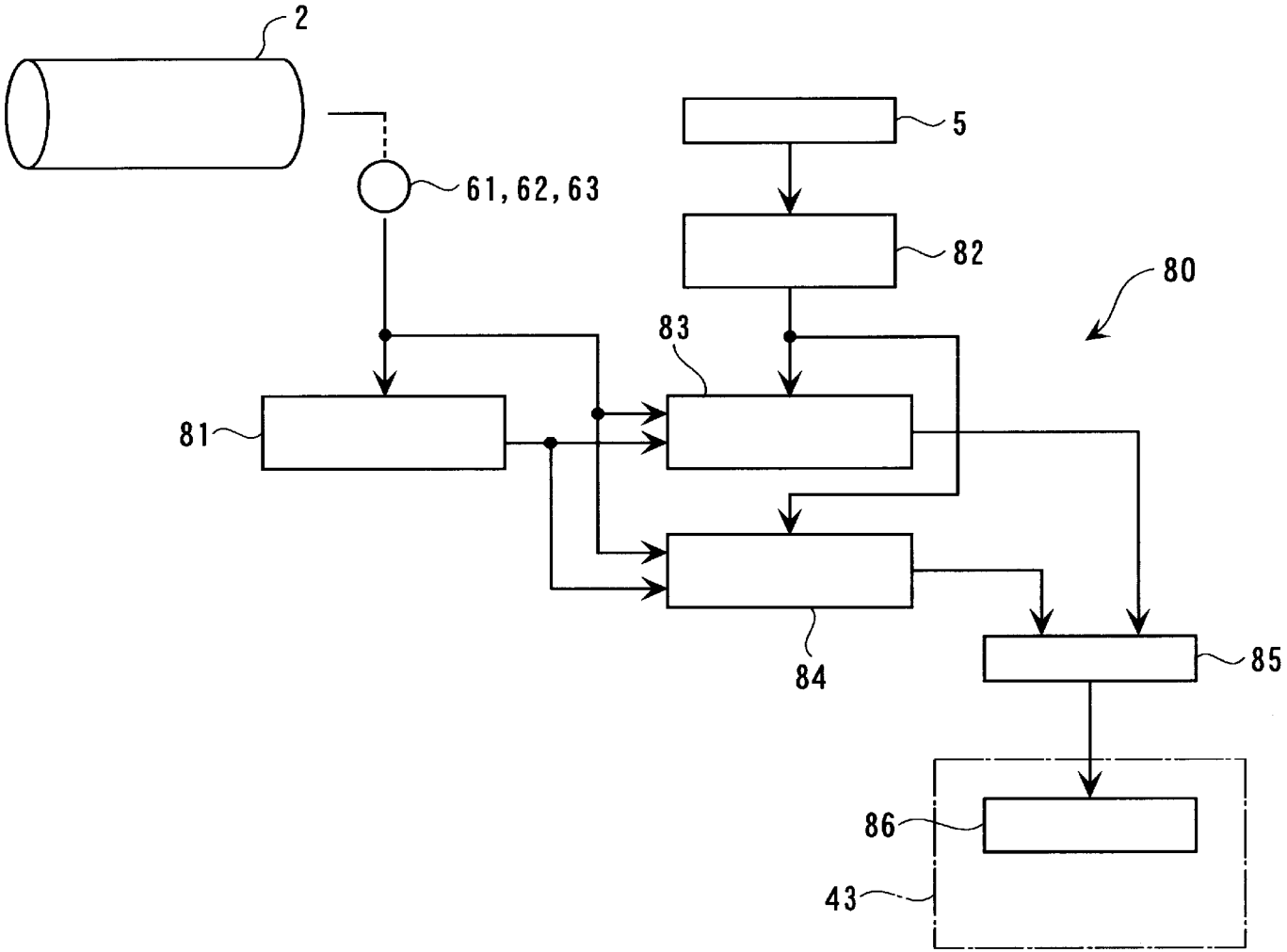
FIG. 15 is a schematic diagram for illustrating the printing register control device of the printer of the above embodiment.
Figure 16:
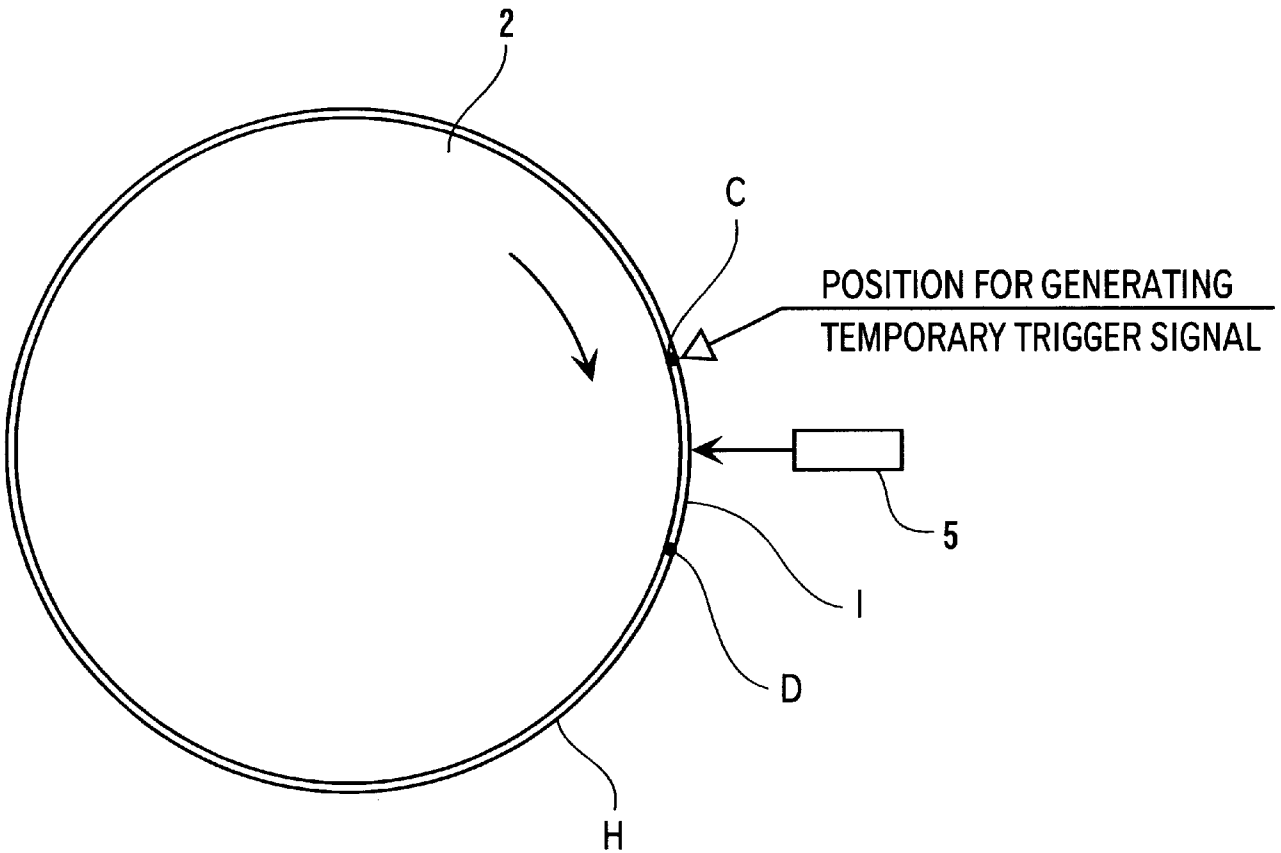
FIG. 16 is a schematic diagram for illustrating the positional relationship between the drawing original point, exposure position, and so on of the above embodiment.

Next, a printing resister control device used in the printing apparatus with reference to FIG. 15 and FIG. 16.

A printing register control device 80 of the printing apparatus comprises: a temporary-drawing trigger signal generation part 81 that provides a drawing-initiating trigger signal generation position to the exposure device on the basis of rotation angle detecting signals generated from the encoders 61, 62, 63 that detect the rotation angle of the photoconductor drum 2; a drawing synchronization signal interface 82 mounted on the exposure device 5 for generating a drawing synchronization signal for an exposure signal to be outputted to the exposure device 5; a memory part 83 for storing a first color initial rotation angle; a memory part 84 for storing a N-th color initial rotation angle; a phase difference calculation part 85; and a phase difference correction circuit 86 mounted on the phase difference calculation part 43.

In the temporary drawing trigger signal generation part 81, when the drawing original point C is arrived at a position for the generation of a drawing initiation trigger signal by a rotary motion of the photoconductor drum 2, a temporary drawing trigger signal for first color is generated and a drawing synchronization signal from the exposure device 5 is allowed to pass through the memory part 83 for storing 1st initial rotation angle. Upon generating a first drawing synchronization signal, the rotation angle of the photoconductor drum 2 is detected and is then stored in the memory part 83 for storing first color initial revolution angle.

Subsequently, the scanning movement is repeated for "n" times. During this period, the drawing data is provided as dummy data. If a "n+1" th drawing synchronization signal is generated after the generation of temporary drawing trigger signal, then the drawing of one line is performed on the basis of the drawing signal after passing a predetermined time (i.e., T seconds) from the synchronization signal detection position in the exposure control part 44 as explained in the above description for FIG. 7. Thus, an actual drawing is initiated at the time of drawing the first line.

Here, the peripheral speed of the photoconductor drum 2 is previously regulated to be shifted for one dot per one surface scanning time of the polygon scanner 31. In addition, the drawing is performed while maintaining a two dimensional synchronization of the peripheral length and width of the photoconductor drum 2 until the last drawing line B is drawn. After completing the development of the last drawing line B of the first color, fog is removed form the resulting image by a fog-removing means 25, followed by driving with a drying means 26. Then, the developing means 6 is shifted for preparing a second development.

In the procedure for second color, when the drawing initial point C is arrived at the position for generating a terminal drawing trigger signal, the temporary drawing trigger signal generation part 81 generates a second color drawing trigger signal just as in the case with the first color. Thus, a drawing synchronization signal from the exposure device 5 becomes effective ageist a memory part 84 for storing N-th color initial rotation angle. If the first drawing synchronization signal is generated, then the rotation angle of the photoconductor drum at this time is detected and is then stored in the memory part 84.

Subsequently, the difference between the rotation speed stored in the memory part 83 for storing the first initial rotation angle and the rotation speed stored in the memory part 84 for storing the N-th initial rotation angle, i.e., the phase difference, is calculated by a phase-difference calculation part 85 and is then provided to a phase-difference correction circuit 86 of the phase-synchronization control part 43. The correction on such a phase difference is performed until the time when the generation of n-th drawing synchronization signal is completed after the generation of second color temporary drawing trigger signal.

Here, "n" is an integral multiple, i.e., 2-fold, 3-fold, and so on.

Figure 5:
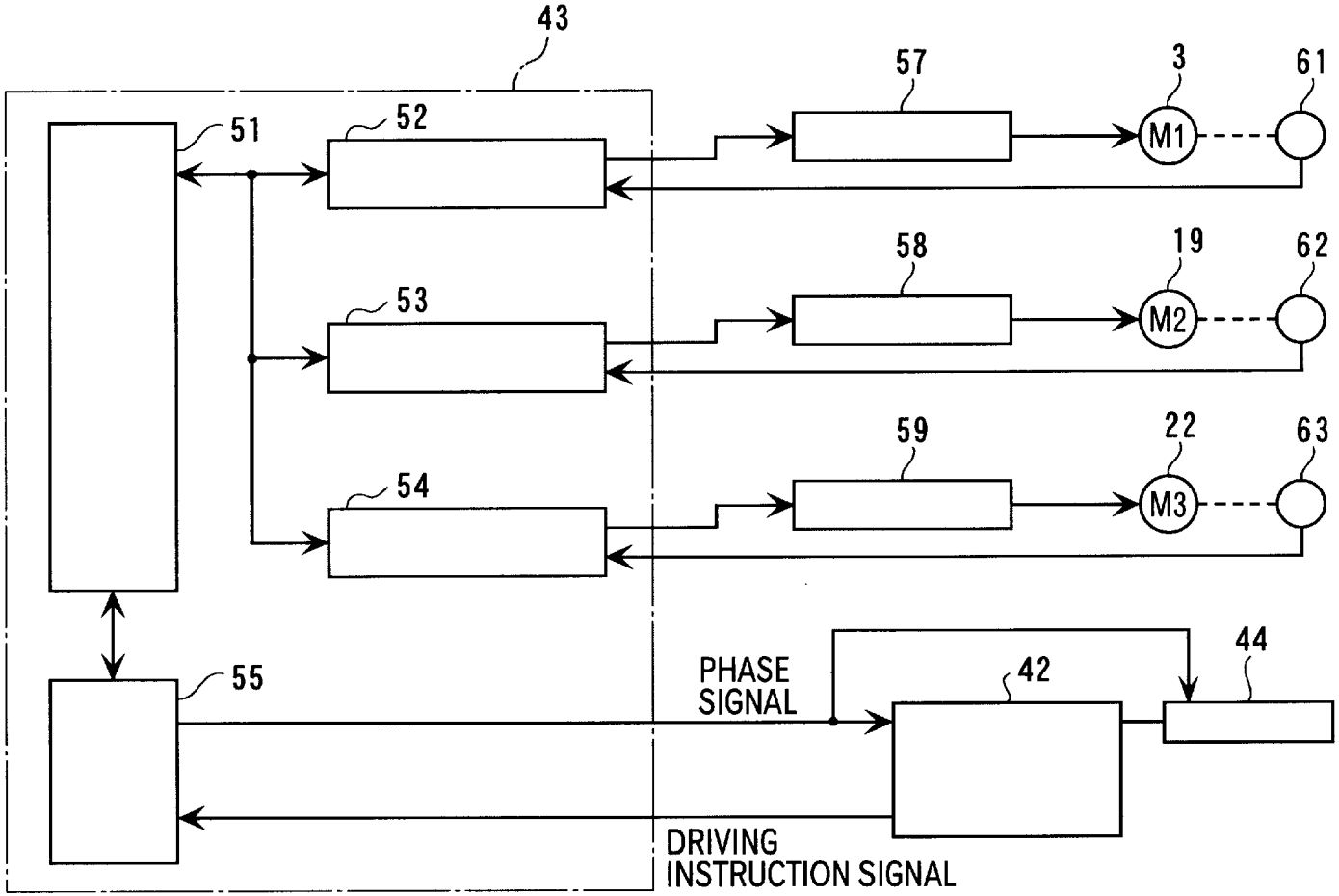
FIG. 5 is a block diagram for illustrating the phase synchronization part of the above embodiment.
Figure 6:
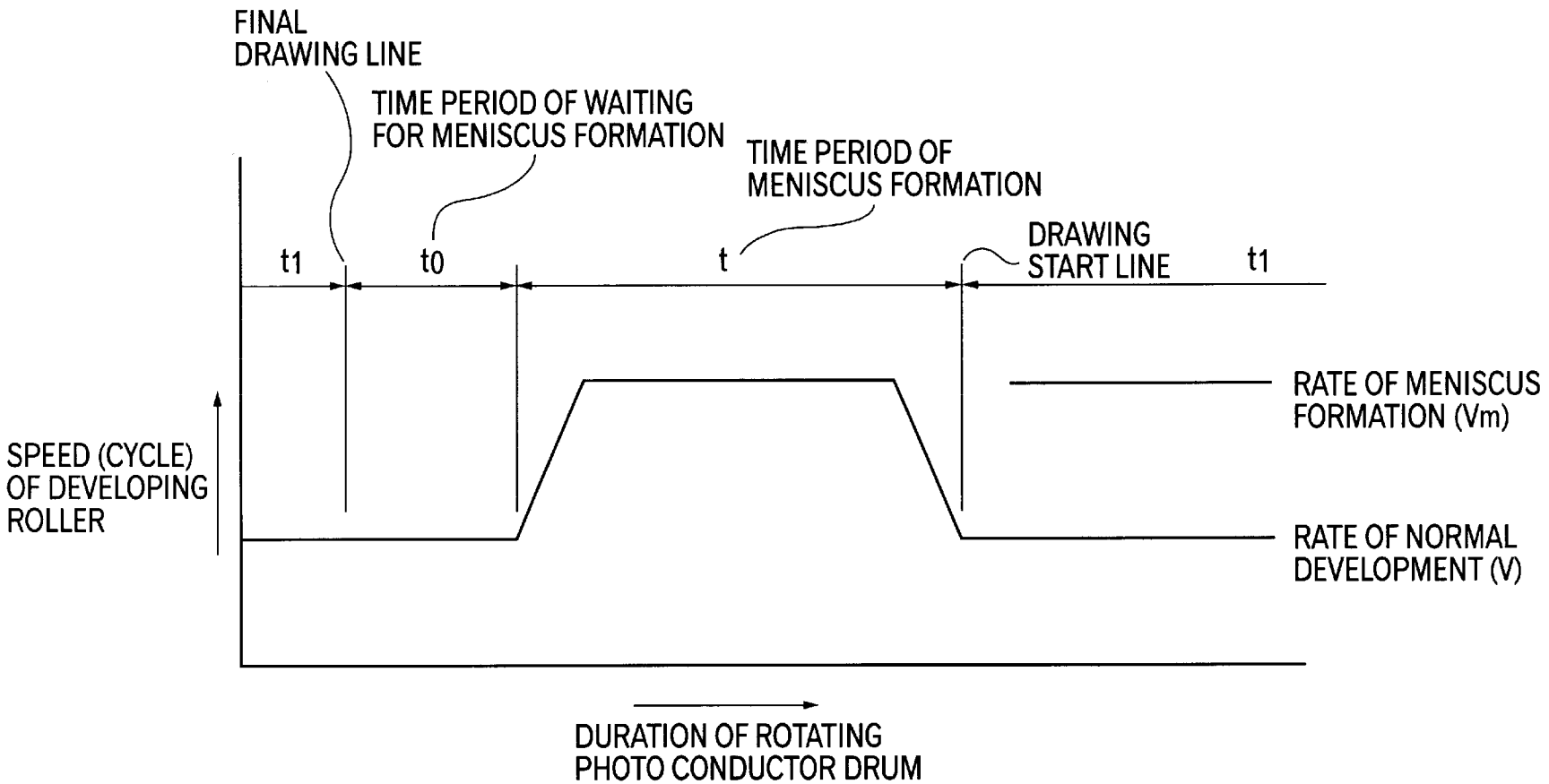
FIG. 6 is an operation chart for illustrating the relationship between the rotation of the photoconductor drum and the rotation of the developing roller of the above embodiment.
Figure 17:
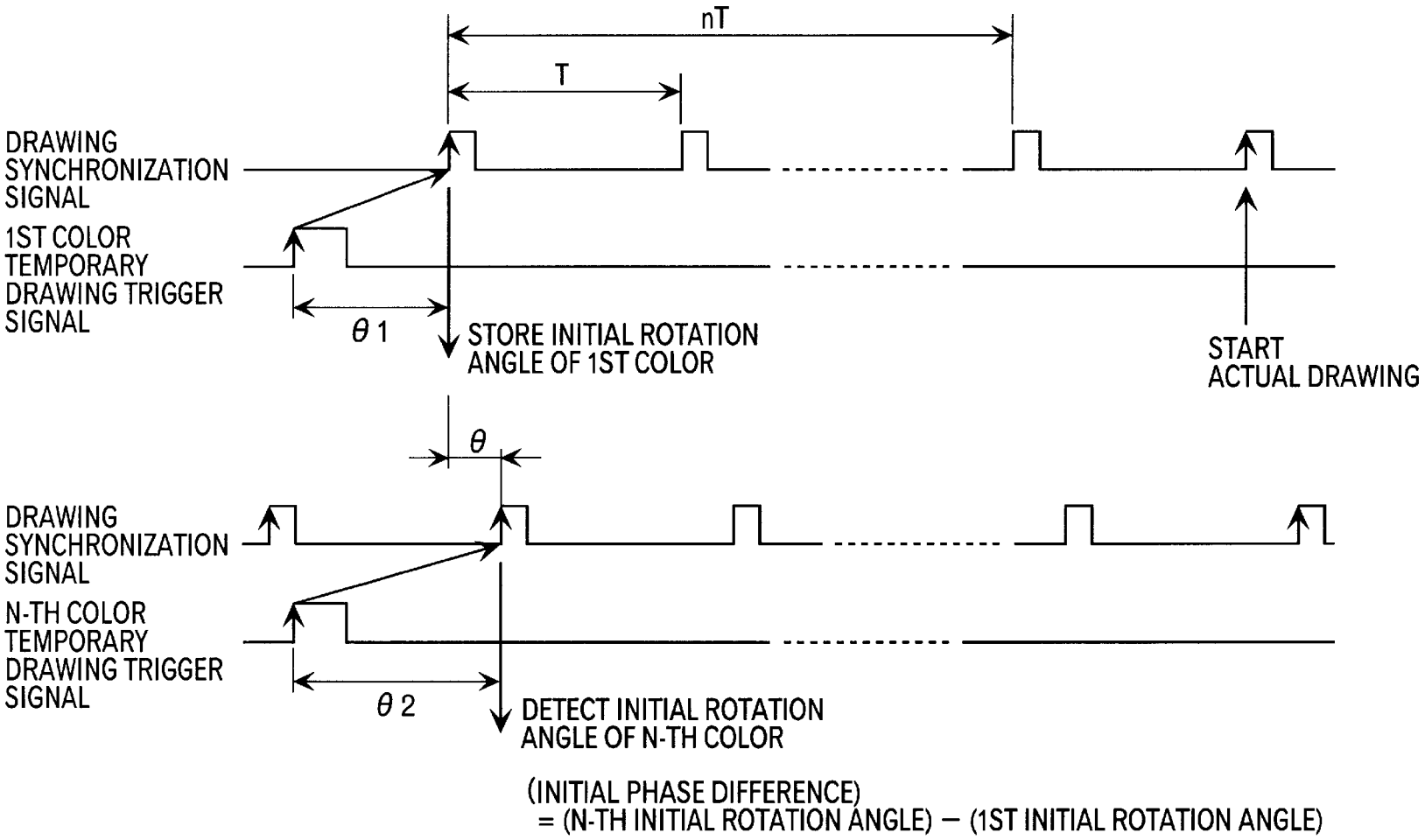
FIG. 17 is a timing chart for illustrating the timing between the temporary drawing trigger signal and the drawing synchronization signal of the above embodiment.

In this case, the phase-difference correction circuit 86 is included in the DSP part 51 of the phase-synchronization control part 43 (see FIG. 5). As shown in FIG. 17, if the cycle of generating a drawing synchronization signal from the exposure device 5 is set to T seconds, then the correction may be completed within a time period of nT seconds in which an n-th drawing synchronization signal is generated. Therefore, the correction can be performed by overriding the correction speed which can be obtained from the phase difference and the correction time (nT) on the speed at the time of normal drawing for T seconds.

That is, the initial rotation angle for first color is $\theta 1$ with respect to the position of first color temporary drawing signal, while the initial rotation angle for N-th color is $\theta 2$ with respect to the position of N-th color temporary drawing signal, where the angle $\theta 2$ is slightly shifted from the angle $\theta 1$ For correcting the phase difference $\theta$ for starting the actual drawing of N-th color, the rotation of the photoconductor drum 2 should be faster than the speed thereof at the time of normal drawing rotation.

In contrast, if the initial rotation angle for N-th color is smaller than the initial rotation angle for first color (i.e., $\theta 1 > \theta 2$ photoconductor drum 2 should be lower than the speed thereof at the time of normal drawing rotation.

Figure 8A:
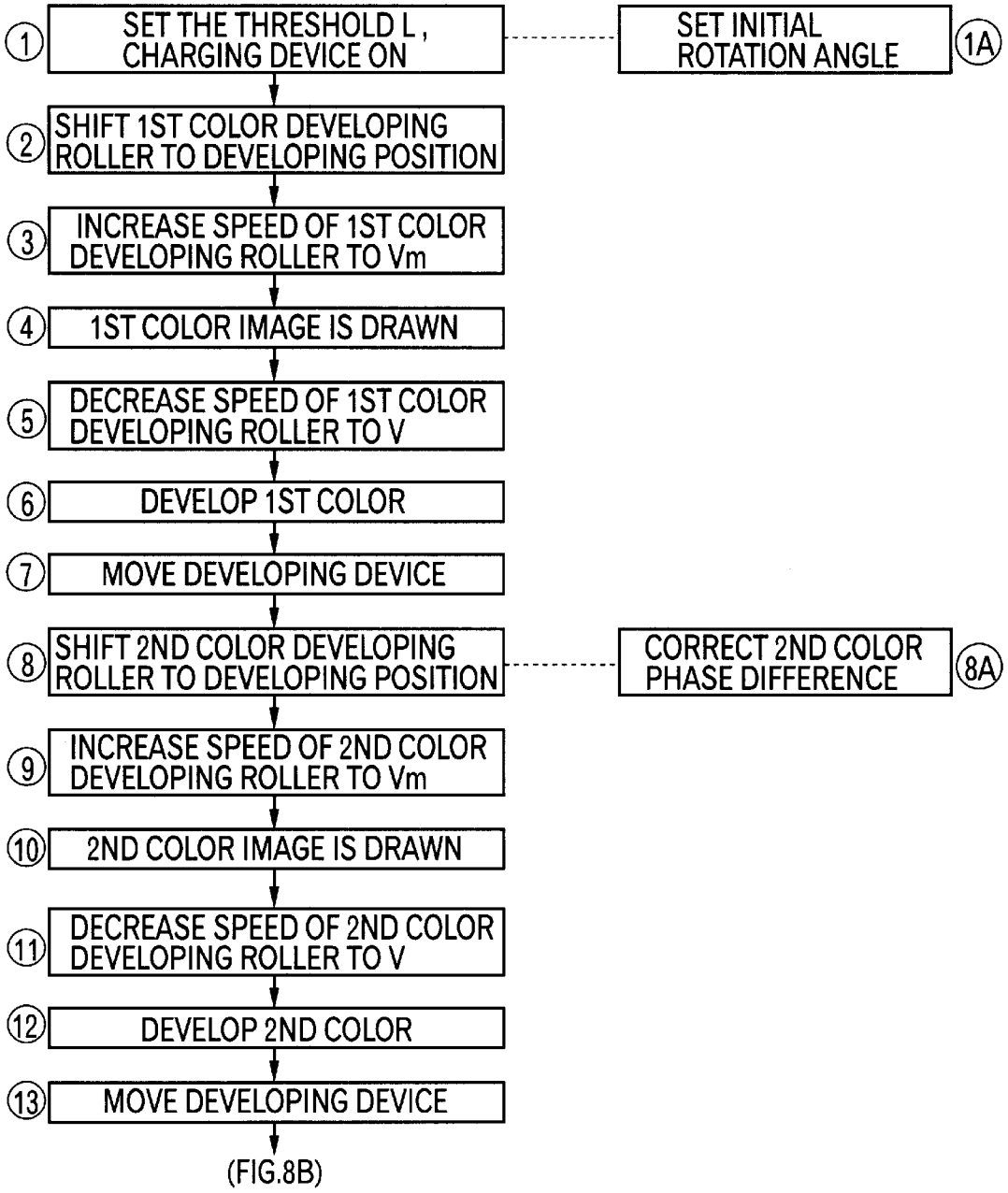
FIG. 8A and FIG. 8B are flow charts for illustrating the printing movement of the above embodiment.
Figure 8B:
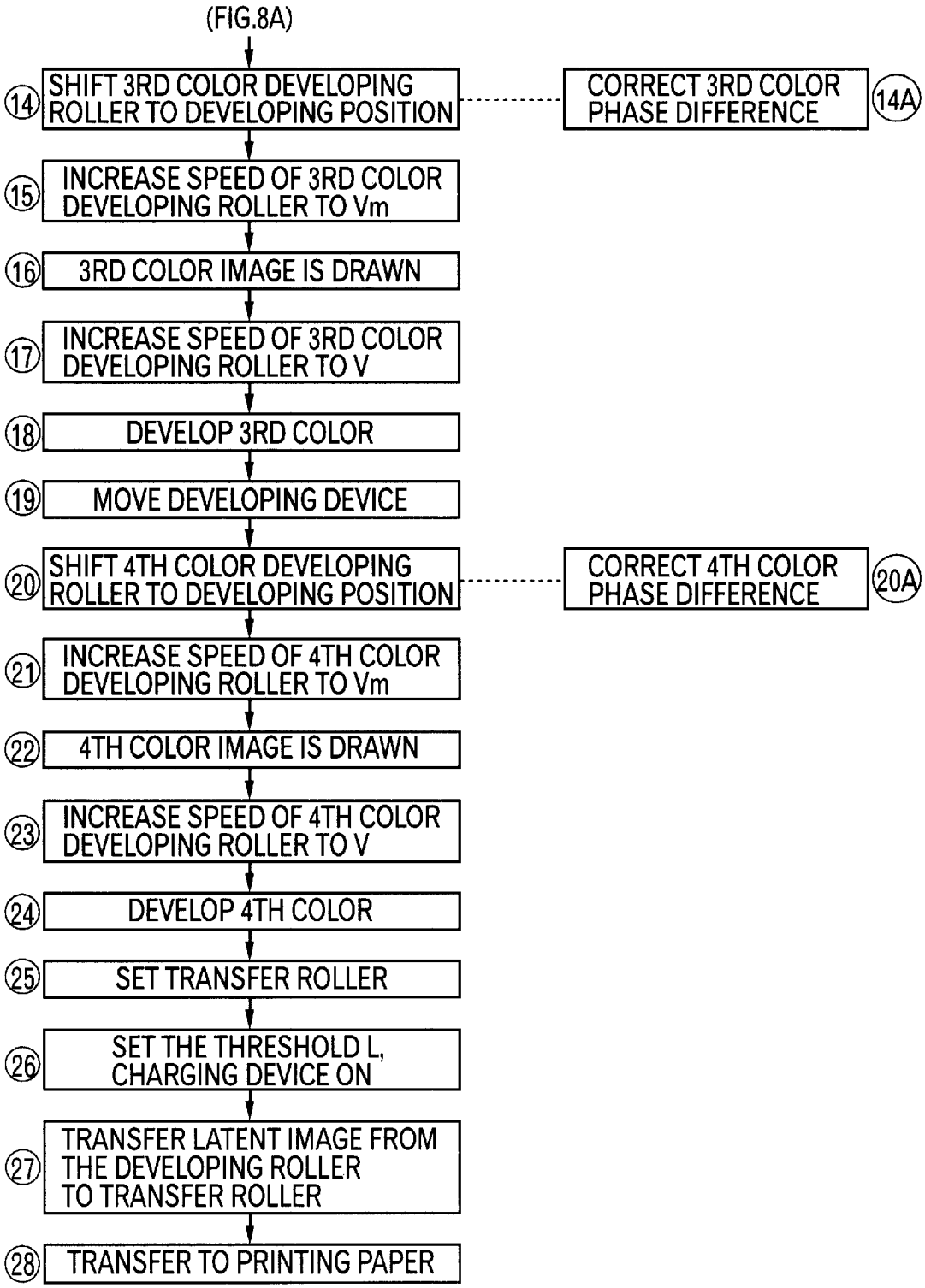

Next, we will describe a printing movement of the printing apparatus of the above first embodiment with reference to the flow charts shown in FIG. 8A and FIG. 8B.

At first, the distance L between the developing rollers 13A–13D and the photoconductor drum 2 is set to a predetermined extent of space thereof for allowing an image formation under the most favorable conditions. The setting of such a distance is performed prior to the development for each of colors.

Then, the drawing data previously prepared by the drawing data preparation part 45 is transmitted to the exposure control part 44 and is then converted into an exposure signal.

Subsequently, the process control part 42 transmits a predetermined driving instruction signal to the phase-synchronization part to actuate the first, second, and third servo motors 3, 19, 22 in synchronism with each other.

The first, second, and third servomotors 3, 19, 22 impart rotary motions of the photoconductor drum 2, the transfer roller 18, and the backup roller 21, respectively, in synchronism with each other. In addition, the process control part 42 actuates the developing-device driving motor 16 of the developing means 6 to rotate the first developing roller 13A and the first supporting roller 14 at a normal developing speed V, respectively.

Then, a drawing original point C is defined on the photoconductor drum 2 and the encoder detection angle of the drawing original point C is stored in the memory part 42A by means of the phase-synchronization control part 43. Subsequently, when the drawing original point C is arrived at a charging position of the charging device 4, the process control part 42 actuates the charging device 4 (Step 1) to charge the surface of the photoconductor drum 2. Here, an initial rotation angle for first color is stored in the memory part 83 (Step 1A).

The process control part 42 actuates the developing-device moving motor 9 of the developing means 6 to move the toner storage chamber 11A downward so as to be positioned below the photoconductor drum 2 (Step 3). The toner storage chamber 11A stores liquid toner of fist color (e.g., yellow). Furthermore, the process control part 42 controls the operation of the developing-device driving motor 16 of the developing means 6 to allow the ration of each of the first developing roller 13A and the first supporting roller 14A at a predetermined speed. In this state, the development is not performed for the time period to, so that these rollers are rotated at a normal developing speed V.

When the time period t0 is passed after synchronizing the rotations of the rollers 13A, 14A with the rotation of the photoconductor drum 2, the process control part 42 controls the operation of the developing-device moving motor 9 to increase the rotation speeds of the first developing roller 13A and the first supporting roller 14A to the speed Vm of meniscus formation (Step 3).

Then, when the exposure device 5 is arrived at the exposure position, one line for fist color (e.g., yellow) is drawn while maintaining the synchronization with the drawing position on the basis of the exposure signal previously converted by the exposure control part 44 (Step 4). The peripheral speed of the photoconductor drum 2 is previously regulated to be shifted for one dot per one surface scanning time of the polygon scanner 31. In addition, the drawing is performed while maintaining a two dimensional synchronization of the peripheral length G and width F of the photoconductor drum 2 until the last drawing line B is drawn. After completing the development of the last drawing line B of the first color, fog is removed form the resulting image by a fog-removing means 25, followed by driving with a drying means 26. Then, the developing means 6 is shifted for preparing a second development.

Subsequently, as shown in FIG. 4, before the drawing original point C is arrived at the developing position, the process control part 42 controls the operation of the developing-device driving motor 16 to decrease the rotation speeds of the first developing roller 13A and the first supporting roller 14A to the normal developing speed V (Step 5). That is, when the drawing original point C is arrived at the developing position, these rollers 13A, 14A are decelerated to the normal developing speed V.

Furthermore, when the drawing original point C is arrived at the developing position, the development of first color is initiated (Step 5). That is, the first color liquid toner 12A is transferred from the first developing roller 13A to an electrostatic latent image formed on the surface of the photoconductor drum 2, causing a printing image. After completing the development of final drawing line B of first color, the developing means 6 is shifted for the development of second color. That is, the motor 9 is actuated to shift the location of the developing means 6 (Step 7).

Here, at the time of completing the development of final drawing line B of first color, the process control part 42 recognizes the initiation of calculating an elapsed time t0. Then, the toner storage chamber 11B for storing liquid toner of second color (e.g., magenta) is moved downward and placed below the photoconductor drum 2 as the developing-device moving motor 9 is actuated at Step 7 (Step 8). Here, the rotation angle stored in the memory part 83 for storing the first initial rotation angle and the rotation speed for second color stored in the memory part for storing the N-th initial rotation angle is calculated by a phase-difference calculation part 85 and is then provided to a phase-difference correction circuit 86 of the phase-synchronization control part 43. The correction on such a phase difference is performed until the time when the generation of n-th drawing synchronization signal is completed after the generation of second color temporary drawing trigger signal (Step 8A).

Then, just as in the case with the development for first color, when the time period t0 is passed after synchronizing with the rotation of the photoconductor drum 2, the process control part 42 controls the operation of the developing-device driving motor 16 to increase the rotations of the second developing roller 13B and the second supporting roller 14B to the speed Vm of meniscus formation (Step 9).

Subsequently, when the exposure device 5 is arrived at the exposure position, one line for second color (e.g., magenta) is drawn while maintaining the synchronization with the drawing position on the basis of the exposure signal previously converted by the exposure control part 44 (Step 10).

Before the drawing original point C is arrived at the developing position, the process control part 42 controls the operation of the developing-device driving motor 16 to decrease the rotation speeds of the second developing roller 13B and the second supporting roller 14B to the normal developing speed V (Step 11).

Furthermore, when the drawing original point C is arrived at the developing position, the development of second color is initiated. That is, the second color liquid toner 12B is transferred from the second developing roller 13B to an electrostatic latent image formed on the surface of the photoconductor drum 2, causing a printing image (Step 12). Just as in the case with the development of first color, after completing the development of final drawing line B of second color, the developing means 6 is shifted for the development of third color (Step 13). The toner storage chamber 11C that stores liquid toner 12C of third color (e.g., cyan) is positioned below the photoconductor drum 2 (Step 14). Here, the phase difference between the rotation speed stored in the memory part 83 for storing the first initial rotation angle and the rotation speed for third color stored in the memory part 84 for storing the N-th initial rotation angle is calculated by a phase-difference calculation part 85 and is then provided to a phase-difference correction circuit 86 of the phase-synchronization control part 43. The correction on such a phase difference is performed until the time when the generation of n-th drawing synchronization signal is completed after the generation of third color temporary drawing trigger signal (Step 14A).

Then, just as in the case with the development for each of first and second colors, when the time period to is passed after synchronizing with the rotation of the photoconductor drum 2, the process control part 42 controls the operation of the developing-device driving motor 16 to increase the rotations of the third developing roller 13C and the third supporting roller 14C to the speed Vm of meniscus formation (Step 15).

Subsequently, when the exposure device 5 is arrived at the exposure position, one line for third color (e.g., cyan) is drawn while maintaining the synchronization with the drawing position on the basis of the exposure signal previously converted by the exposure control part 44 (Step 16). Before the drawing original point C is arrived at the developing position, the process control part 42 controls the operation of the developing-device driving motor 16 to decrease the rotation speeds of the third developing roller 13C and the third supporting roller 14C to the normal developing speed V (Step 17).

Furthermore, when the drawing original point C is arrived at the developing position, the development of third color is initiated. That is, the third color liquid toner 12C is transferred from the third developing roller 13C to an electrostatic latent image formed on the surface of the photoconductor drum 2, causing a printing image (Step 18). Just as in the case with the development of first or second color, after completing the development of final drawing line B of third color, the developing means 6 is shifted for the development of fourth color (Step 19). The toner storage chamber 11D that stores liquid toner 12D of fourth color (e.g., black) is positioned below the photoconductor drum 2 (Step 20). Here, the phase difference between the rotation speed stored in the memory part 83 for storing the first initial rotation angle and the rotation speed for fourth color stored in the memory part 84 for storing the N-th initial rotation angle is calculated by a phase-difference calculation part 85 and is then provided to a phase-difference correction circuit 86 of the phase-synchronization control part 43. The correction on such a phase difference is performed until the time when the generation of n-th drawing synchronization signal is completed after the generation of fourth color temporary drawing trigger signal (Step 20A).

Then, just as in the case with the development for each of first, second, and third colors, when the time period t0 is passed after synchronizing with the rotation of the photoconductor drum 2, the process control part 42 controls the operation of the developing-device driving motor 16 to increase the rotations of the fourth developing roller 14D and the fourth supporting roller 14D to the speed Vm of meniscus formation (Step 21).

Subsequently, when the exposure device 5 is arrived at the exposure position, one line for fourth color (e.g., black) is drawn while maintaining the synchronization with the drawing position on the basis of the exposure signal previously converted by the exposure control part 44 (Step 22). Before the drawing original point C is arrived at the developing position, the process control part 42 controls the operation of the developing-device driving motor 16 to decrease the rotation speeds of the fourth developing roller 13D and the fourth supporting roller 14D to the normal developing speed V (Step 23).

Furthermore, when the drawing original point C is arrived at the developing position, the development of fourth color is initiated. That is, the fourth color liquid toner 12D is transferred from the fourth developing roller 13D to an electrostatic latent image formed on the surface of the photoconductor drum 2, causing a printing image of full color in an image-on-image fashion (Step 24). As the final drawing line B of fourth color passes through the position of the charging device 4, the process control part 42 turns the charging device 4 off.

After completing the development of last fourth color, the process control part 42 controls a transfer roller detachable/attachable actuator 47 such that the transfer roller 18 is brought into contact with the surface of the photoconductor drum 2. In other words, they are press-contact with each other (Step 25). Then, the process control part 42 controls a backup roller detachable/attachable actuator 48 such that the backup roller 21 is brought into contact with the transfer roller 18. In other words, they are press-contact with each other (Step 26).

Subsequently, an image developed on the photoconductor dram is transferred to the transfer roller 18 being press-contact with the photoconductor drum 2 (Step 27).

Furthermore, the paper-feed actuator 49 is actuated by the process control part 42 to feed a sheet of printing paper between the transfer roller 18 and the backup roller 21, allowing the transfer of an image from the transfer roller 18 to the printing paper (Step 28).

Consequently, the printing apparatus of the present embodiment is constructed as described above, so that the following advantages can be obtained.

(1) The distance L between the surface of each of the first, second, third, and fourth developing rollers 13A–13D and the surface of the photoconductor drum 2 can be adjustable, so that the distance L can be appropriately defined for various kinds of printing movements, depending on the rotation speeds of the photoconductor roller and developing rollers, the properties of liquid toner. The distance L may be selected from various dimensions previously defined on the basis of practical and experimental experiences and stored in the memory part 42A. Consequently, the liquid toner can be supplied with an appropriate distance that allows the formation of a clear image, so that an image with an excellent quality can be maintained while avoiding an influence upon an image.

(2) Each of the first, second, third, and fourth developing rollers 13A–13D individually mounted on the respective toner storage chambers 11A–11D is capable of independently adjusting the distance L with the photoconductor drum 2, so that it is possible to absorb errors in the manufacture of each developing roller 13A–13D and errors in the installation. Therefore, each of the developing rollers 13A–13D is able to keep the distance at a constant, so that the high quality printing can be attained.

(3) Liquid toner of each color to be printed can be stored in one of the toner storage chamber 11A–11D and the developing rollers 13A–13D are provided for the respective chambers 11A–11D, so that multi-color printing can be performed without causing undesired mixing of colors, adapting to better meet various customers' needs.

(4) Using the non-drawing area 1, the main body of the developing device 6A and the developing rollers 13A–13D shift their positions, so that their movements do not affect on the drawing. Therefore, the drawing movement can be smoothly and rapidly shifted from one color to the next color. The drawing area H and the non-drawing area I are present, so that it is possible to adapt to the various sizes of the printing paper as the range of the non-drawing area I can be varied if required. Therefore, the printing apparatus having one photoconductor drum 2 and one transfer roller is capable of printing on various kinds of printing paper, so that the manufacture and arrangement of the photoconductor drum 2 or the like can be easily performed.

(5) The transfer roller 18 is being detached from the photoconductor drum 2 until the development of the photoconductor drum 2 by the developing means 6 is completed. Also, the backup roller is being detached from the transfer roller 18 until the printing paper is placed between the backup roller 21 and the transfer roller 18. Therefore, the development of multi-color printing on the surface of the photoconductor drum 2 can be performed without any obstruction and the backup roller 21 does not obstruct the paper feed, so that the printing can be performed smoothly.

(6) The photoconductor drum 2, the transfer roller 18, and the backup roller 21 can be rotated with their phases in synchronism with each other under the controls of the control means 41, respectively. Therefore, there is no displacement of drawing positions, so that a high-quality printing can be attained.

(7) The output level of laser for drawing color from the laser output control device 70 allows the selection of color to be drawn from the color combination data and the selection of pixel in which color to be draw is incorporated. A pixel having color corresponding to the selected pixel is selected from the laser output data memory part and is then provided as laser output data of color to be drawn, so that the power of laser can be varied depending on whether colors are stacked one after another or not, or depending on the other conditions. Consequently, a clear image can be obtained.

(8) The output level of color to be drawn may be defined with reference to the laser output memory part 75 in which laser output data for each color of every combination of colors. The laser output data corresponds to drawing data DB of color combinations in which drawing data DA is prepared for each pixel. Therefore, for example, there is no need to provide 8 bits of data for one dot to be required in 256 levels of gradation. Therefore, one-eighth of data can be reduced. Therefore, the capacity of the recording device for storing laser output data can be reduced.

(9) The laser output data is provided in the laser output data memory part 75 so as to be possible to address all of combinations obtainable from colors. Thus, the laser data can be always defined for any color to be drawn.

(10) In the printing register control device 80 of the printing apparatus, the phase difference between the initial rotation angles of the photoconductor drum 2 stored in the first color initial rotation memory part 83 and the N-th color initial rotation angle memory part 84 is calculated at the phase difference calculation part 85. Depending on the results of such a calculation, the correction for changing the rotation speed of the photoconductor drum 2 by the phase difference correction circuit 86 during the time period until a synchronization signal for initiating an actual drawing is generated. Therefore, the initiation of actual drawing of fist color always corresponds to that of second or other color, so that the register of each color can be maintained at a high level when multi-color printing is performed. As a result, the printing material with a high quality can be obtained.

(11) The photoconductor drum 2 is driven by the servo motor 3. A feedback encoder signal from the servo motor 3 is concurrently used with a rotation angle detecting encoder of the photoconductor drum 2. Thus, two different functions can be attained by one encoder, so that the number of components to be used can be reduced.

(12) The time period from an initial synchronization signal after the generation of first color temporary drawing trigger signal to a synchronization signal of fist color actual drawing initiation is an integral multiple of a cycle of exposure scanning movement, so that there is no output of the synchronization signal of actual drawing initiation during the exposure scanning. Therefore, each color can be registered more perfectly.

(13) The fog removal means 25 removes fog from the image after the development by the developing means 6. Therefore, the resulting image can be of uniform thickness and can be directly dried by the drying means 26. Therefore, the drying is rapidly completed and the development of color can be smoothly shifted to second or subsequent color.

As described above, the printing apparatus of the present embodiment described above have the following effects.

(1) Before the development, one of the first, second, third, and fourth developing rollers 13A–13D is rotated at a speed corresponding to the speed Vm of meniscus formation which is faster than the developing speed V equal to the rotation speed thereof at the time of the development. Therefore, the supply of the liquid toner 12A–12D for one of the first, second, third, and fourth developing rollers 13A–13D corresponding to the photoconductor drum 2 can be increased. Therefore, meniscus of the liquid toner 12A–12D can be immediately formed between one of the first, second, third, and fourth developing rollers 13A–13D and the photoconductor roller 2, immediately allowing the stable environmental conditions, stable developing conditions, and the improvement in printing quality.

(2) After rotating one of the first, second, third, and fourth developing rollers 13A–13D at rapid speed, which is close to the photoconductor drum 2, it should be decreased to the rotation speed thereof to be used at the time of development before the development. Therefore, it becomes possible to avoid unstable development and the decrease in printing quality which can be caused by an excess amount of liquid toner 12A–12D to be supplied between the photoconductor drum 2 and one of the first, second, third, and fourth developing rollers 13A–13D.

(3) A plurality of the first, second, third, and fourth developing rollers 13A–13D are provided for a plurality of liquid toners 12A–12D. The developing-device movable motor 9 is appropriately actuated to move the developing means 6 to form a printing image by developing each color. Therefore, a plurality of liquid toners 12A–12D cannot be mixed with each other, allowing a good multi-color printing and adapting to better meet various customers' needs.

(4) For changing color, for example, in the case that a printing image is developed for each color of liquid toners 12A–12D, and one of the first, second, third, and fourth developing rollers 13A–13D in place is moved away from the photoconductor, while another one selected from these rollers 13A–13D is brought near to the photoconductor drum 2, before the development, the first, second, third, and fourth developing rollers 13A–13D is rotated at the speed of meniscus formation faster than the normal development speed. Therefore, meniscus can be quickly formed when the change of colors takes place, so that a stable development can be attained and the image quality can be improved.

(5) In the case of forming a printing image by developing each color of a plurality of liquid toners 12A–12D, the developing means 6 can be moved using the non-drawing area I. Thus, the movement of the moving means 6 does not effect on the drawing, so that it is possible to shift from one color to the next color to be drawn. In addition, the drawing area H and non-drawing area I are provided, so that the range of non-drawing area I can be varied to correspond to the different sizes of printing paper. Therefore, the printing on each of various kinds of printing paper can be performed using only one photoconductor drum 2 together with the transfer roller 18, so that the manufacture and arrangement of the photoconductor drum 2 can be easily performed.

(6) After the development of each color on the photoconductor drum, the transfer roller 18 is press-contact to the photoconductor drum 2. Therefore, the development of photoconductor drum for multi-color printing can be performed stably and smoothly, without an influence of the transfer roller 18.

(7) The photoconductor drum 2, the transfer roller 18, and the backup roller 21 can be rotated with their phases in synchronism with each other under the controls of the control means 41, respectively. Therefore, there is no displacement of drawing positions, so that a high-quality printing can be attained.

The present invention is not limited to the above embodiment any configuration that attains the object of the present, for example the following modified embodiments, can be allowed.

In the above embodiment, the distance L between the photoconductor drum 2 and each of the first to fourth developing roller 13A–13D can be independently adjustable. However, the present invention is not limited to such a configuration. The distance L may be adjusted such that these rollers 13A–13D are regarded as a one unit.

The printing apparatus of the present embodiment is not limited to one in which the image formation is generally performed by stacking four colors one after another. Alternatively, the printing may be performed by stacking eight colors including specific colors 1–4.

The main body of the developing means 6A may have toner storage chambers 11A–11H. Each of eight color liquid toners can be stored in its corresponding chamber in a one-to-one fashion. In this case, for example, the toner storage chamber 11A stores liquid toner of first color (e.g., yellow) among four process colors. The toner storage chamber 11B stores liquid toner of second color (e.g., cyan), the toner storage chamber 11G stores liquid toner of seventh color (e.g., specific color 3), the toner storage chamber 11H stores liquid toner of eighth color (e.g., specific color 4). The other toner storage chambers 11C, 11D, 11E, 11F may include liquid toners of magenta, black, specific color 1, and specific color 2, respectively. Here, "specific color" may be gold or the like as clear as it is written.

In the above description, the configuration of the printing apparatus performs a printing movement using a plurality of liquid toners (e.g., four liquid toners). Alternatively, for example, one or three liquid toners may be used. If one kind of liquid toner is used, there is no need to provide the developing-device moving motor 8 and the developing-mechanism moving mechanism 8.

In the above embodiment, the feedback encoder signal from the servo motor 3 is used in conjunction with a rotation angle detecting encoder of the photoconductor drum 2. However, they can be provided independently.

The printing apparatus 1 is not limited to a proof device for providing a trial sheet of printed material but also a printing apparatus in which an electrostatic latent image formed on the photoconductor drum 2 is developed by supplying liquid toners 12A–12D through the first, second, third, and fourth developing rollers 13A–13D, respectively.

The diameter of backup roller 21 is not limited to equal to that of the photoconductor drum 2. Alternatively, they may be different from each other.

In the above embodiment, the first, second, third, and fourth developing rollers 13A–13D are provided for a plurality of the liquid toners 12A–12D, respectively. However, it is possible to use only one developing roller for the development o each color. In this case, for printing the next color, the residual liquid toners 12A–12D of the previous color are removed to prevent the mixture of different ink toners.

What is claimed is:

1. A laser output control device to be used in a wet-type electro photographic printing apparatus having a photoconductor drum with a surface on which an image is formed, a charging means for charging the surface of the photoconductor drum, an exposure means for preparing an electrostatic latent image by irradiating a laser beam on the surface of the photoconductor drum, and a developing means for developing the electrostatic latent image on the surface of the photoconductor drum by stacking a plurality of colors thereon, comprising:

a laser output data memory part for storing laser output data for each color of every combination of the plurality of colors;

a color combination data memory part for storing drawing data as color combination data for each of pixels;

a laser control part for controlling the laser beam by selecting laser output data corresponding to a color to be drawn, wherein the laser control part selects the color to be drawn from the color combination data in the color combination data memory part, selects a pixel including the color to be drawn, selects a pixel having the same color combination as that of the selected pixel from the laser output data memory part, together with selecting the same color as the color to be drawn from the pixel, and provides the laser output data corresponding to the selected color as laser output data of the color to be drawn.

2. A laser output control device of a wet-type electro photographic printing apparatus according to claim 1, wherein the plurality of colors includes at least two colors.

3. A method of laser output control in a wet-type electro photographic printing apparatus having a photoconductor drum with a surface on which an image is formed, a charging means for charging the surface of the photoconductor drum, an exposure means for preparing an electrostatic latent image by irradiating a laser beam on the surface of the photoconductor drum, and a developing means for developing the electrostatic latent image on the surface of the photoconductor drum by stacking a plurality of colors thereon, where the laser beam is controlled by a laser control part, comprising the steps of:

storing laser output data for each color of every combination of the plurality of colors in a laser output data memory part;

storing drawing data as color combination data for each of pixels in a color combination data memory part;

selecting the color to be drawn from the color combination data in the color combination data memory part by the laser control part;

selecting a pixel having the same color combination as that of the selected pixel from the laser output data memory part, together with selecting the same color as the color to be drawn from the pixel; and providing the laser output data corresponding to the selected color as laser output data of the color to be drawn.

* * * * *

UNITED STATES PATENT AND TRADEMARK OFFICE

CERTIFICATE OF CORRECTION

PATENT NO. : 6,559,874 B2
DATED : May 6, 2003
INVENTOR(S) : Tanaka et al.

It is certified that error appears in the above-identified patent and that said Letters Patent is hereby corrected as shown below:

Title page,
Item [54], please correct the title as follows:
-- [54] PRINTING METHOD AND PRINTING APPARATUS, LASER OUTPUT CONTROL DEVICE AND CONTROL METHOD FOR PRINTING APPARATUS, AND PRINTING REGISTER CONTROL DEVICE FOR PRINTING APPARATUS --

Signed and Sealed this

Twentieth Day of January, 2004

JON W. DUDAS
*Acting Director of the United States Patent and Trademark Office*